US006288735B1

(12) United States Patent
Naramoto et al.

(10) Patent No.: US 6,288,735 B1
(45) Date of Patent: Sep. 11, 2001

(54) COLOR IMAGE RECORDING METHOD, COLOR IMAGE RECORDING APPARATUS, AND COLOR IMAGE RECORDING CONTROLLING METHOD

(75) Inventors: Shoji Naramoto; Masaaki Yoshida; Tomoaki Kasugaya; Norio Takahashi; Masafumi Kobayashi, all of Chiba (JP)

(73) Assignee: Seiko I Infotech Inc. (JP)

( * ) Notice: Subject to any disclaimer, the term of this patent is extended or adjusted under 35 U.S.C. 154(b) by 0 days.

(21) Appl. No.: 09/008,159

(22) Filed: Jan. 16, 1998

(30) Foreign Application Priority Data

Jan. 16, 1997 (JP) ..... 9-005732

(51) Int. Cl.[7] ..... B41J 2/32
(52) U.S. Cl. ..... 347/172
(58) Field of Search ..... 347/172, 41, 42

(56) References Cited

U.S. PATENT DOCUMENTS 5,555,011 * 9/1996 Tang et al. .

* cited by examiner

*Primary Examiner*—Huan Tran
(74) *Attorney, Agent, or Firm*—Adams & Wilks

(57) ABSTRACT

To suppress color moire in a color image recording apparatus, a method for recording a color image by forming recording dots of at least first through third colors on a recording medium in a plurality of lines of recording dots each extending in a main scan direction and a plurality of rows of recording dots each extending in a sub-scan direction, wherein each line is divided into a predetermined number of lines in a sub-scanning direction to form sub-lines, and dots are printed in a respective sub-line for every line. Printing is performed so a respective dot for at least one color is arranged so that the number of sub-lines between the respective recording dot and a recording dot immediately before the respective recording dot in the sub-scanning direction is different from the number of sub-lines between the respective recording dot and a recording dot immediately after the respective recording dot, and in adjacent rows in the main scanning direction, recording dots are formed so that repeating phases of the recording dots differ from each other.

25 Claims, 22 Drawing Sheets

COLOR IMAGE RECORDING METHOD, COLOR IMAGE RECORDING APPARATUS, AND COLOR IMAGE RECORDING CONTROLLING METHOD

BACKGROUND OF THE INVENTION

The present invention relates to a color image recording method, a color image recording apparatus and a color image recording controlling method for forming recording dots of at least three colors on a recording medium, and more particularly to a technique for suppressing a tonal fringe.

A melting type color thermal transfer recording apparatus has been proposed as a color image recording apparatus for forming recording dots of at least three different colors on a recording medium. An ink sheet to which thermally melting ink of three colors, i.e., yellow (hereinafter referred to as Y), magenta (hereinafter referred to as M) and cyan (hereinafter referred to as C) or of four colors, further including black (hereinafter referred to K) is coated in this order in the longitudinal direction is used in the melting type color thermal transfer recording apparatus. Then, the ink sheet and the transfer paper that is the recording medium are overlapped with each other, and the ink is molten by applying heat from a thermal head to the ink sheet, so that the transfer is effected on the transfer paper in the order of Y, M and C or Y, M, C and K. A thermal head is provided with a plurality of heating elements arranged in a linear manner in a main scanning direction. A time width for which a current is applied to the heating elements is controlled so that an area of the recording dots transferred to the transfer paper is controlled to thereby perform the degradation expression.

An example of an array pattern of the recording dots formed on the transfer paper by the conventional melting type color thermal transfer apparatus is shown in FIG. 26. This pattern is such that the four colors of Y, M, C and K are formed each in the main scanning direction and in the sub-scanning direction at 300 dpi (dot pitch=84.7 $\mu$m). Furthermore, by displacing the recording dots in each line by ½ (=42.3 $\mu$m) of the dot pitch in the sub-scanning direction in every other line, the heat of the thermal head is diffused so that good recording dots may be formed. In this specification, the arrangement in which the recording dots in each line are displaced in every other line in the sub-scanning direction will be referred to as one-dot staggered printing.

As shown in FIG. 27, the application of the current is started for every 10 msec for both odd and even lines, and the application of the current is stopped after a lapse of time corresponding to the gradation level. Then, a time difference of 5.0 msec is provided between the timing of starting the application of the current in the odd lines and that of starting the application of the current in the even lines. This timing is determined by synchronizing timing pulses formed for every 2.5 msec. Incidentally, the timing pulses are also in synchronism with a timing for driving a stepping motor for delivering the transfer paper. The vertical dotted lines that are common with all the lines for every 10 msec and at every 300 dpi means reference lines at equal intervals from the printing starting timing.

As shown in FIG. 26, in the case where the resolution in the sub-scanning direction is at 300 dpi, it is ideal that the recording dots are arranged exactly at intervals of 84.7 $\mu$m in the sub-scanning direction. However, as far as the ink sheet and the transfer paper are mechanically transferred by using the motor, so far, it is very difficult to arrange the positions of the recording dots over the entire recording region on every transfer paper one by one without any displacement of 1 $\mu$m. Accordingly, it is actually inevitable that the displacement to some extent (several $\mu$m to several tens of $\mu$m) occurs in the sub-scanning direction from the exact position. Furthermore, in general, the displacement occurs at random to some extent (in a range of several mm to several tens of mm) in the sub-scanning direction in each color and in each printing. FIG. 28 shows an example of an array pattern of the recording dots in the case where portions where C is relatively displaced with respect to Y and M.

In the case where the recording dots are thus displaced relative to each other, even if the printing with the degradation of 50% for each of Y, M and C, the color on the transfer paper does not become a uniform intermediate grey. The reason for this is that the recording dots of a certain color are displaced relative to the recording dots of another color in the sub-scanning direction so that the nominal tone is changed, as a result of which the color fringe (which is so called tonal moire) occurs. The occurrence of the color fringe is accelerated also by the difference in transfer property (density relative to the energy) between the case the ink is directly transferred to the transfer paper and the case the ink is applied to the ink of other color.

The present invention has been made in view of the above-described circumstances, and therefore an object of the present invention is to provide a color image recording apparatus in which the recording dots of at least three kinds of color are formed and the color fringe is suppressed effectively.

SUMMARY OF THE INVENTION

Color image recording method and apparatus according to the present invention are such color image recording method and apparatus that one line is divided into a predetermined number of lines in a sub-scanning direction to form sub-lines, recording dots having at least three different colors are printed on a recording medium, and are characterized in that: in a recording dot for one color, a first recording dot group to be printed in the same sub-line in at least two adjacent rows in a main scanning direction is periodically formed; there is formed adjacent dots to be printed to be in contact with or overlapped with said first recording dot group when the gradation is high and to be printed at positions separated by at least one sub-line in the same row in the main scanning direction for a single recording dot that forms the first recording dot; with respect to a combination of said first recording dot group and said adjacent dot, a combination of another first recording dot group and another adjacent dot is formed to be separated by one or more sub-line, or one or more row; in a recording dot for another kind of color, in the same row in the main scanning direction, one odd number line and one even number line or one even line and one odd line in the sub-scanning direction are formed to be separated by one or more sub-line to form a second recording dot group; and in the adjacent rows in the main scanning direction, positions where said second recording dot group is formed are different from each other; and in a recording dot for still another kind of color, the recording dot is formed in accordance with a rule in which said one kind of color and said other color are different from each other.

In an image pattern array of the printing recording dot according to the present invention, formed as described above, while the respective printing dots that form an image pattern keep a dot diameter suitable for respective gradation data, the dot arrangement as a whole has a certain angle with respect to the entire image.

This angle can be set suitably by setting divisional numbers of the sub-lines and positions of the first and second recording dots. Further, since it is possible to change a combination of Y, M, C that constitute printing or a combination of mask patterns respectively used in respective colors Y, M, C and K, there arises a relative difference between dot arrangement angles of the respective colors, the same effect as the case of changing a screen angle for every color in printing can be obtained to thereby cancel the color fringe.

It is possible to realize formation of an image pattern arrangement of the printing recording dot according to the present invention, by displacing timing of applying energy to recording elements for forming a recording dot in an odd number line or an even number line. For example, in the case where the recording elements are heating elements, it is possible to realize such formation by displacing timing of feeding current to the heating elements in a period of time during which a recording medium is delivered for one line.

According to the present invention, since the recording dots for the respective colors are displaced at random, there is little possibility that the recording dots for the respective colors are overlapped with each other in the same form. In other words, although the displacement between the recording dot for one color and the recording dot for another color itself is rather regular, the originally overlapped portion does not overlap by the relative displacement and the adjacent originally non-overlapped portions become overlapped; on the contrary, the originally non-overlapped portions become overlapped and the adjacent originally overlapped portions become nion-overlapped; or although the originally small-overlapped portion become largely overlapped, the adjacent originally largely-overlapped portion become small, with the result that the macro (observable) change of hue is suppressed. In other words, the occurrence of the color fringe can be suppressed.

BRIEF DESCRIPTION DRAWINGS

DETAILED DESCRIPTION OF THE INVENTION

An embodiment mode of the present invention will now be described in detail with reference to the accompanying drawings.

Figure 1:
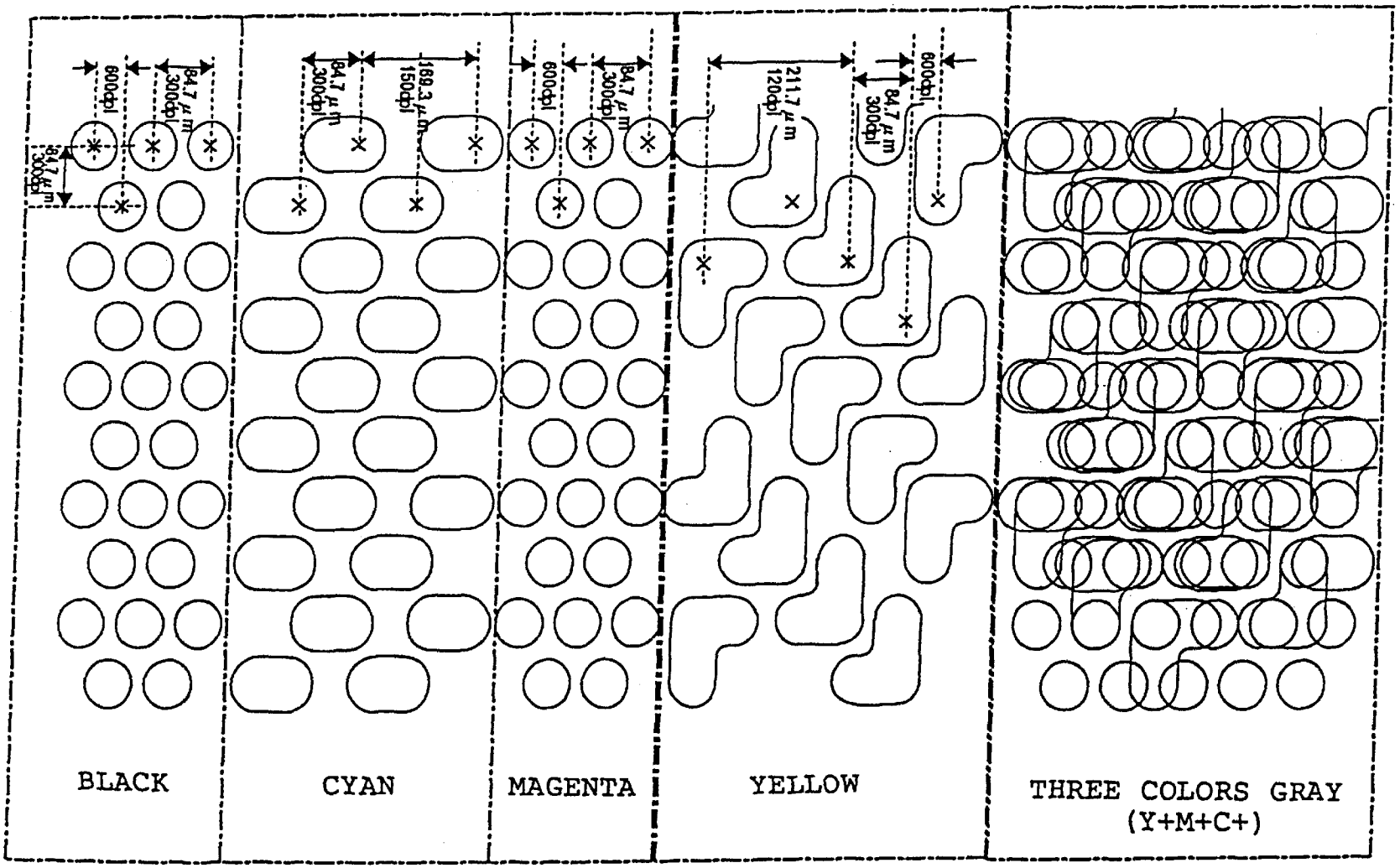
FIG. 1 is a view showing one example of an arrangement pattern of recording dots formed by a melting type color thermal transfer recording method to which the present invention is applied.

An example of an array pattern of the recording dots formed on the transfer paper, which is the recording medium, by a melting type color thermal transfer recording apparatus according to the present invention is shown in FIG. 1. This pattern is that the four colors of Y, M, C and K are formed in this order.

The arrangement of the printing recording dots of each of Y, M, C and K shown in FIG. 1 will now be described hereinunder.

Figure 26:
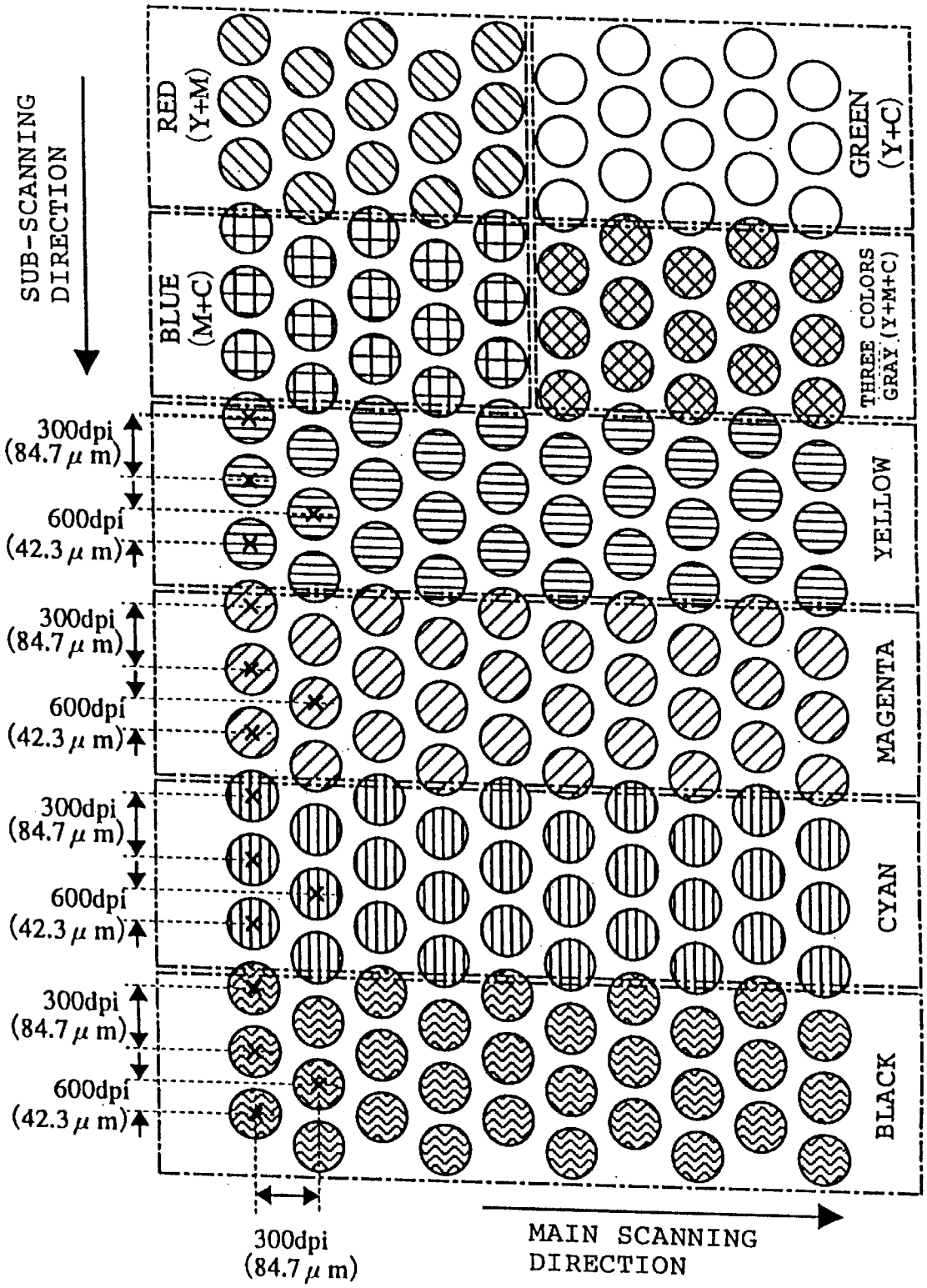
FIG. 26 PRIOR ART
FIG. 26 is a view showing one example of the arrangement pattern of the recording dots formed on the transfer portion in which C is displaced relative to Y and M is present.
Figure 27:
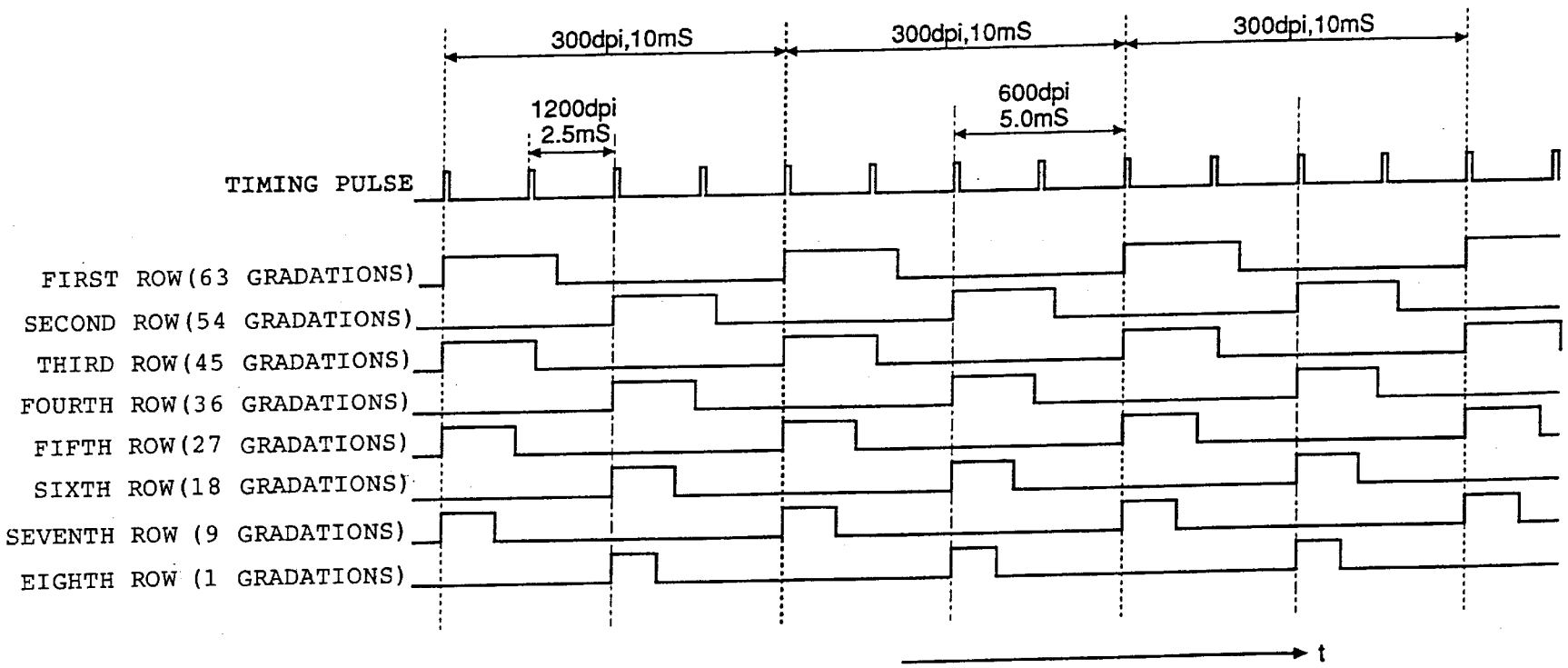
FIG. 27 is a view showing one example of timing of pulses to be applied to the current controlling switch of a thermal head when a staggered print is realized.
Figure 28:
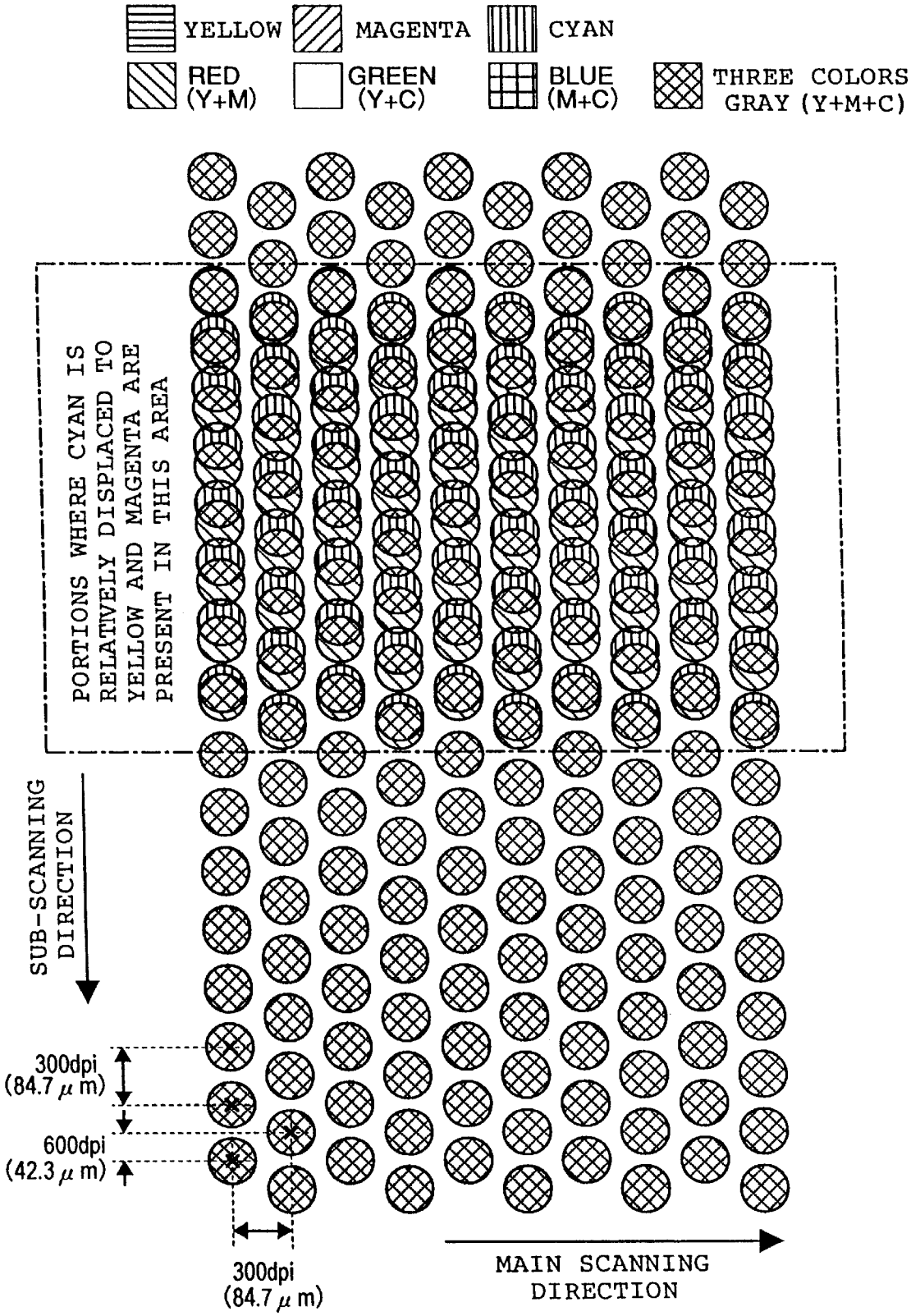
FIG. 28 is a view showing one example of the arrangement pattern of the recording dots in the case where the portion in which is displaced relative to Y and M is present.

First of all, the arrangement of the printing recording dots of K will be described. In FIG. 1, K has the same array which is the same as the pattern shown in FIG. 26. Namely, the resolution of the K pattern both in the main scanning direction and in the sub-scanning direction is set at 300 dpi and the normal one dot staggered printing is carried out.

Figure 2:
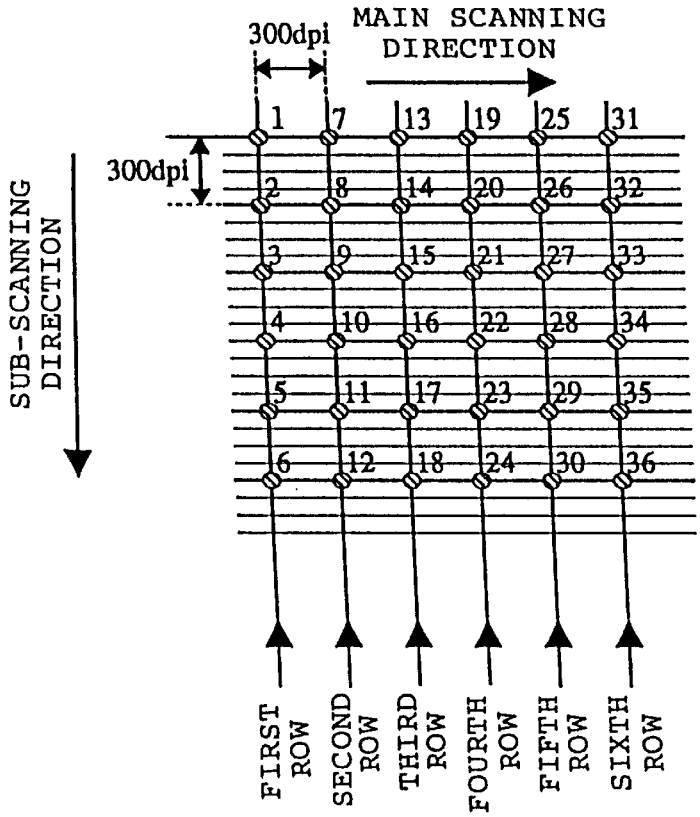
FIG. 2 is a conceptional view of the dot positions of the recording do of Y color formed in accordance with the melting type color thermal transfer recording method to which the present invention is applied.
Figure 3:
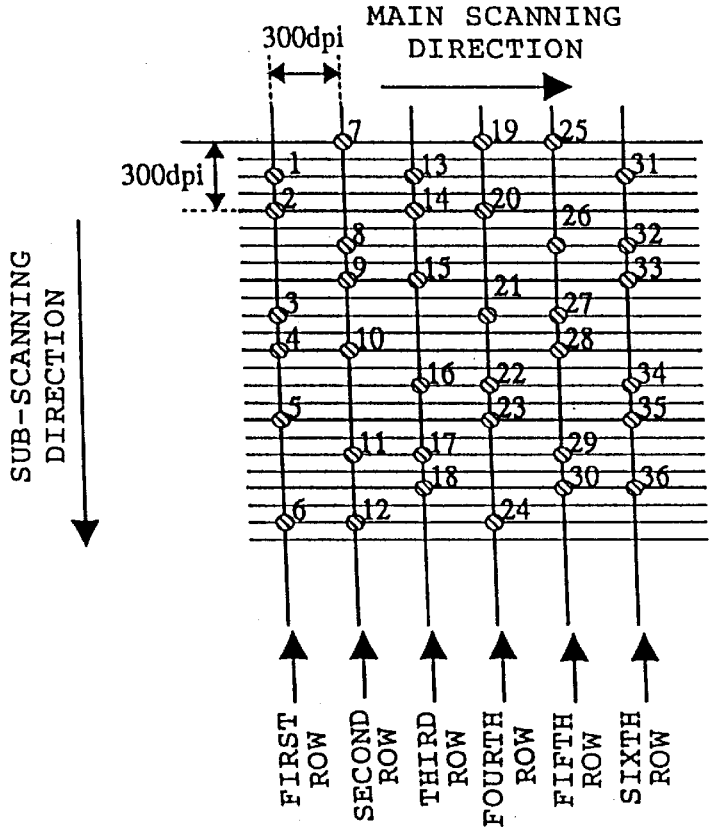
FIG. 3 is a schematic view showing one example of the recording dot arrangement and the form of the recording dots when printing gradation level is 10 for the recording dots of Y color formed in accordance with the melting type color thermal transfer recording method to the present invention is applied.
Figure 4:
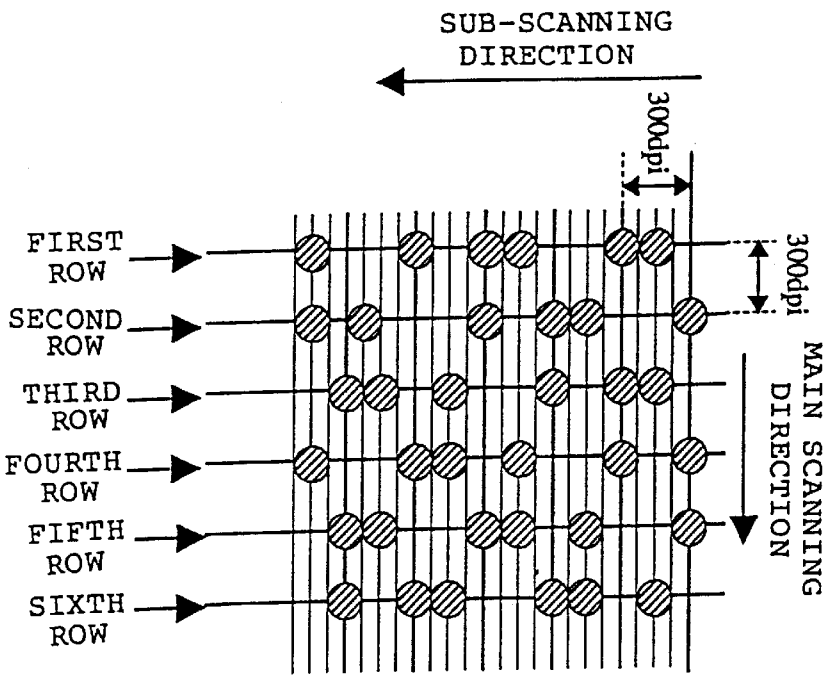
FIG. 4 is a schematic view showing one example of the recording dot arrangement and the form of the recording dots when printing gradation level is 20 for the recording dots of Y color formed in accordance with the melting type color thermal transfer recording method to which the present invention is applied.
Figure 5:
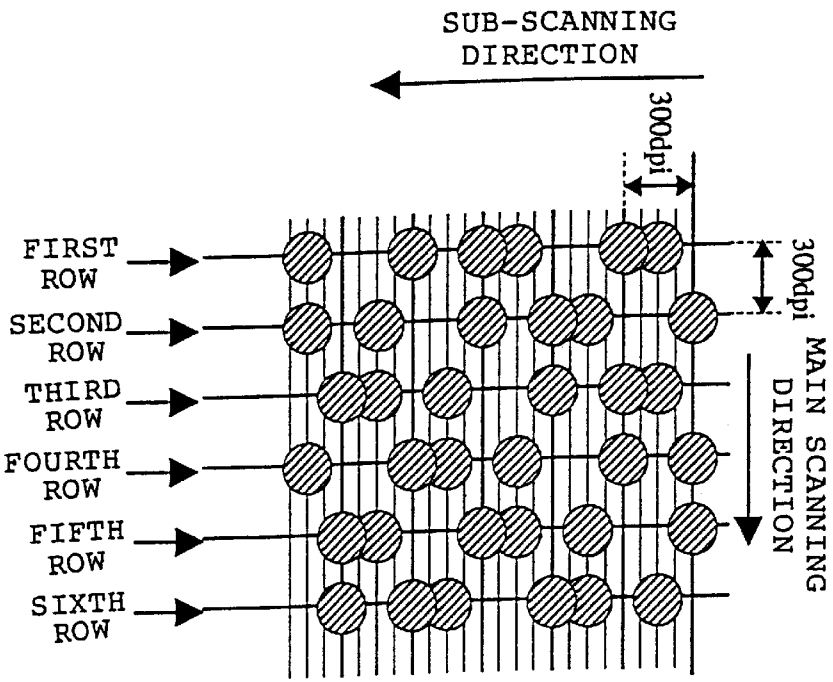
FIG. 5 is a schematic view showing one example of the recording dot arrangement and the form of the recording dots when printing gradation level is 40 for the recording dots of Y color formed in accordance with the melting type color thermal transfer recording method to which the present invention is applied.
Figure 6:
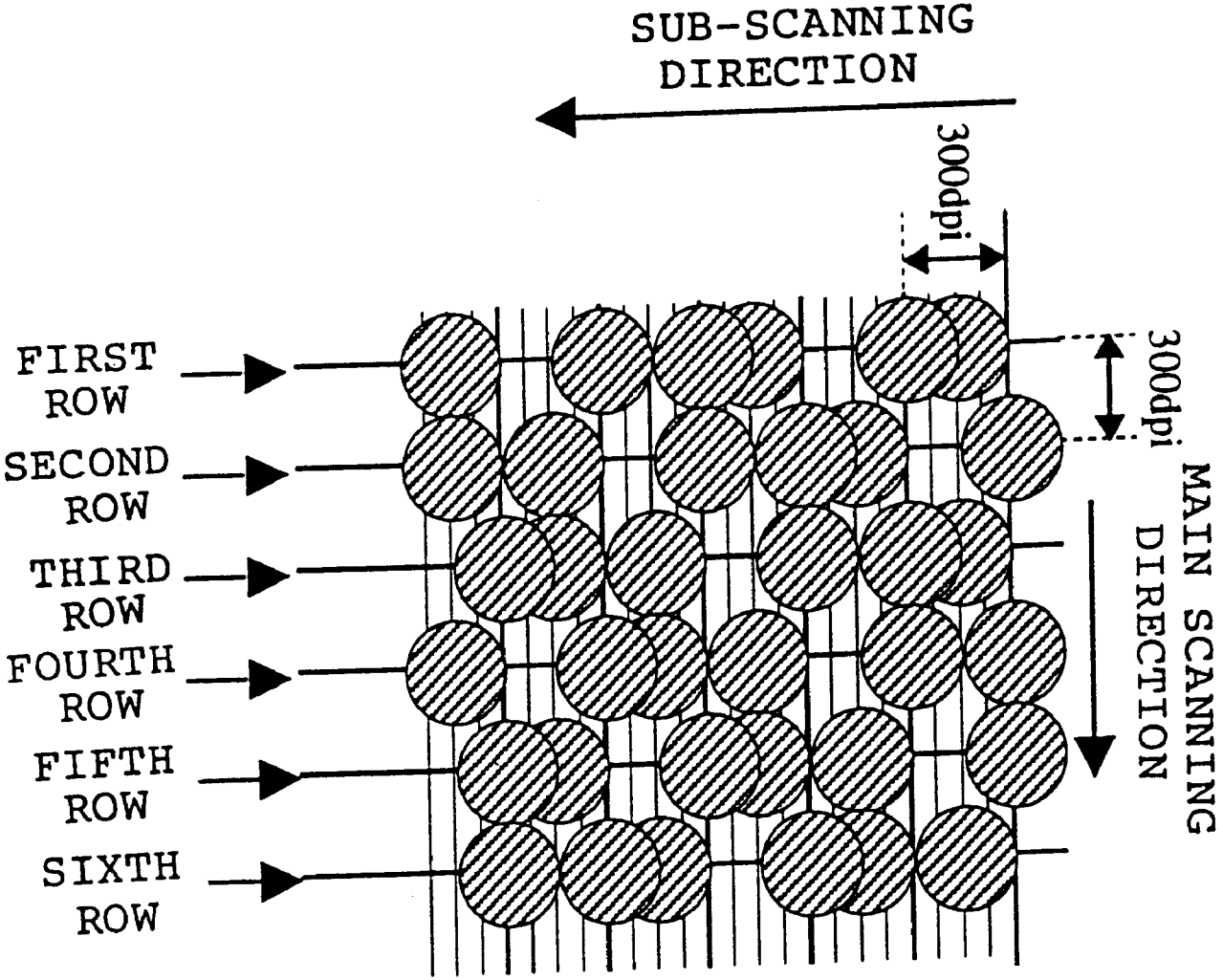
FIG. 6 is a schematic view showing one example of the recording dot arrangement and the form of the recording dots when printing gradation level is 60 for the recording dots of Y color formed in accordance with the melting type color thermal transfer recording method to which the present invention is applied.
Figure 7:
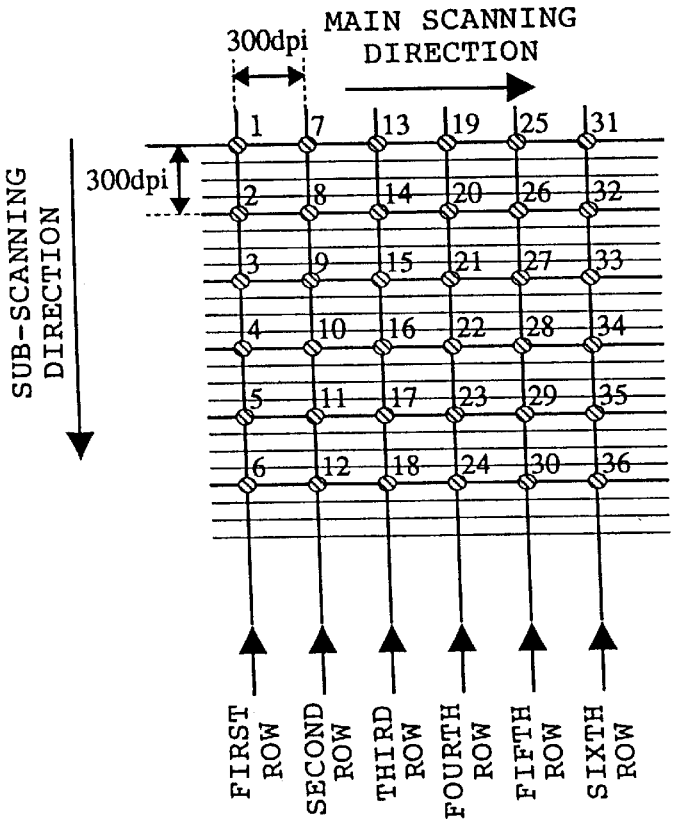
FIG. 7 is a conceptional view of the dot positions of the recording dot of M color formed in accordance with the melting type color thermal transfer recording method to which the present invention is applied.
Figure 8:
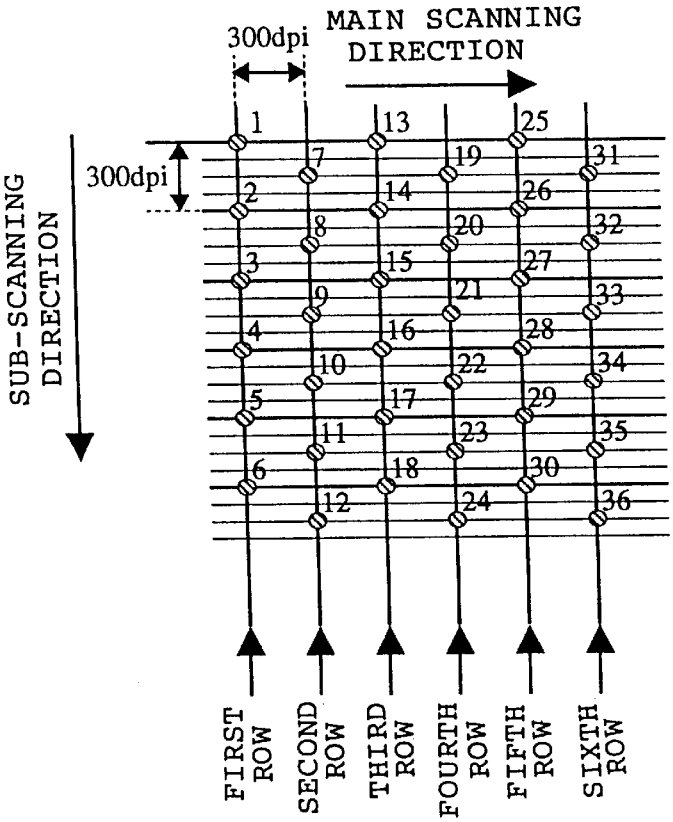
FIG. 8 is a schematic view showing one example of the recording dot arrangement and the form of the recording dots when printing gradation level is 10 for the recording dots of M color formed in accordance with the melting type color thermal transfer recording method to which the present invention is applied.
Figure 9:
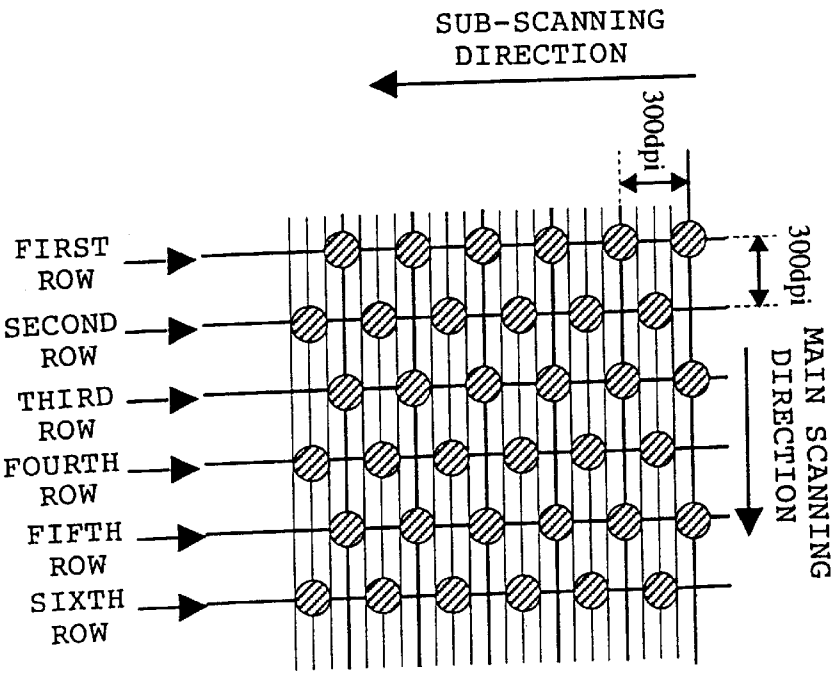
FIG. 9 is a schematic view showing one example of the recording dot arrangement and the form of the recording dots when printing gradation level is 20 for the recording dots of M color formed in accordance with the melting type color thermal transfer recording method which the present invention is applied.
Figure 10:
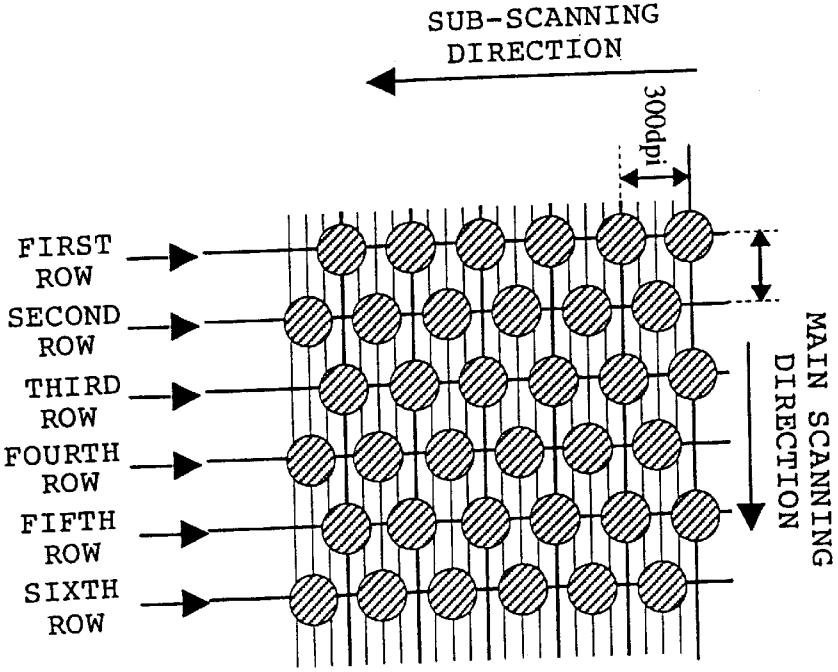
FIG. 10 is a schematic view showing one example of the recording dot arrangement and the form of the recording dots when printing gradation level is 40 for the recording dots of M color formed in accordance with the melting type color thermal transfer recording method to which the present invention is applied.
Figure 11:
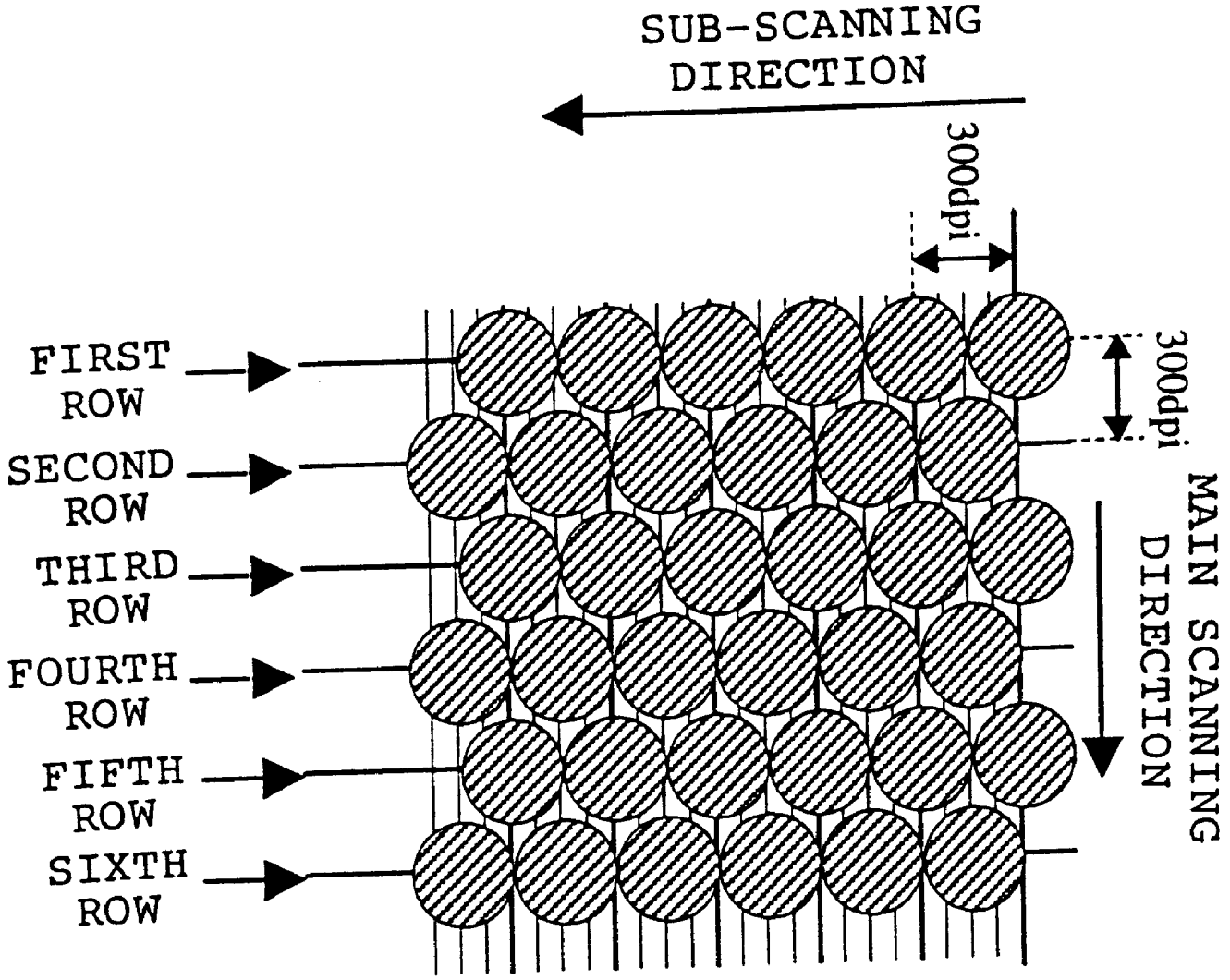
FIG. 11 is a schematic view showing one example of the recording dot arrangement and the form of the recording dots when printing gradation level is 60 for the recording dots of M color formed in accordance with the melting type color thermal transfer recording method to which the present invention is applied.
Figure 12:
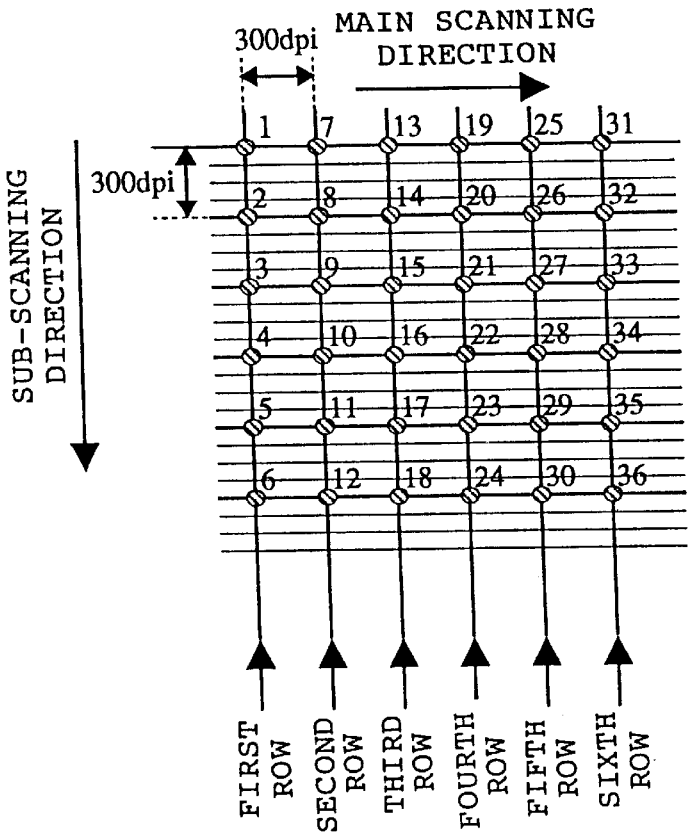
FIG. 12 is a conceptional view of the dot positions of the recording dot of C color formed in accordance with the melting type color thermal transfer recording method to which the present invention is applied.
Figure 13:
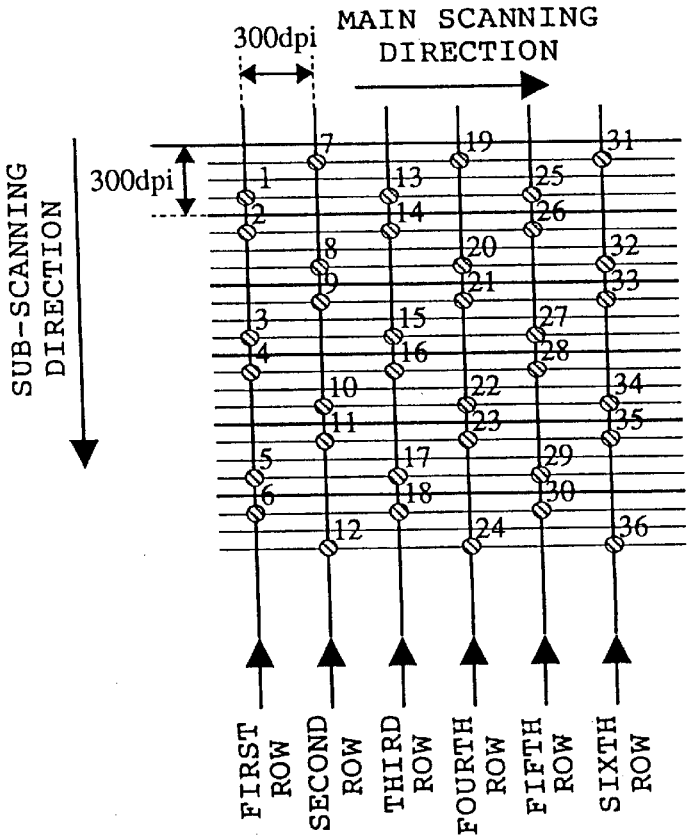
FIG. 13 is a schematic view showing one example of the recording dot arrangement and the form of the recording dots when printing gradation level is 10 for the recording dots of C color formed in accordance with the melting type color thermal transfer recording method to which the present invention is applied.
Figure 14:
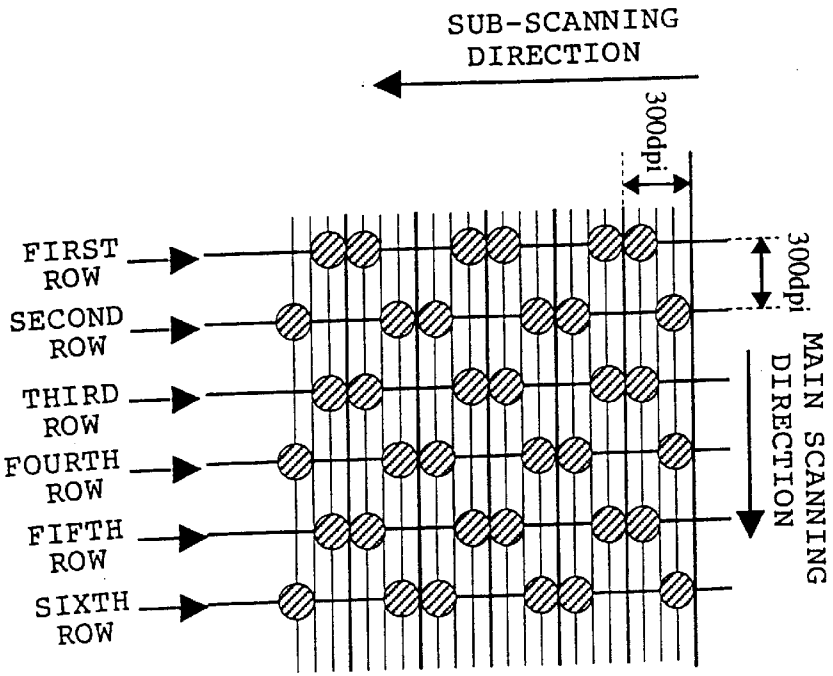
FIG. 14 is a schematic view showing one example of the recording dot arrangement and the form of the recording dots when printing gradation level is 20 for the recording dots of C color formed in accordance with the melting type color thermal transfer recording method to which the present invention is applied.
Figure 15:
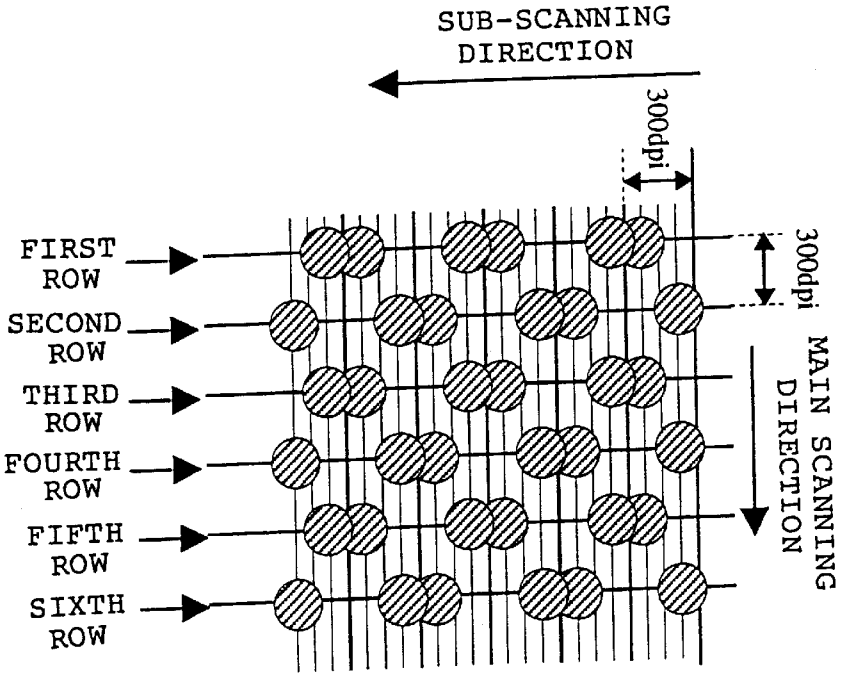
FIG. 15 is a schematic view showing one example of the recording dot arrangement and the form of the recording dots when printing gradation level is 40 for the recording dots of C color formed in accordance with the melting type color thermal transfer recording method to which the present invention is applied.
Figure 16:
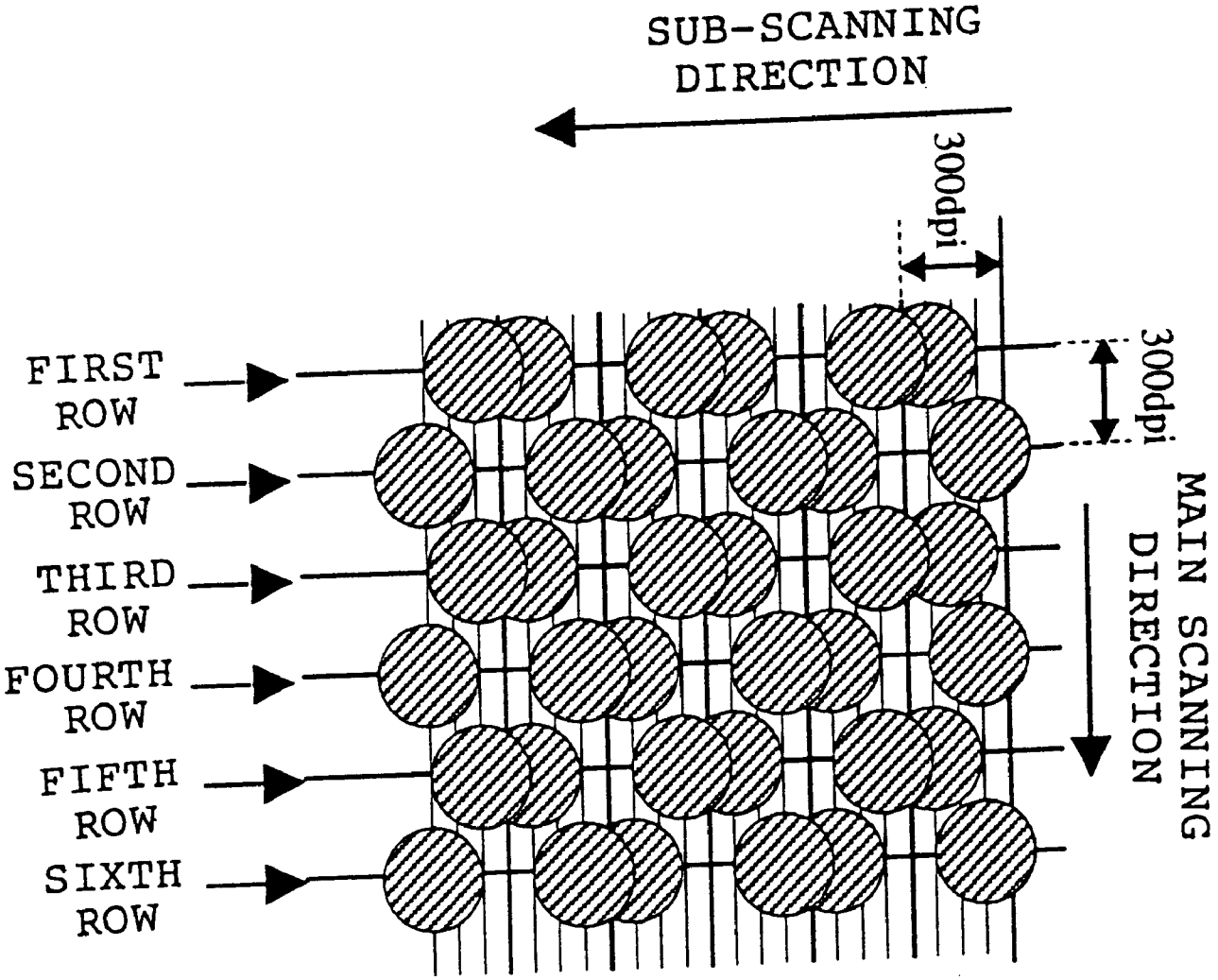
FIG. 16 is a schematic view showing one example of the recording dot arrangement and the form of the recording dots when printing gradation level is 60 for the recording dots of C color formed in accordance with the melting type color thermal transfer recording method to which the present invention is applied.

The array of the printing recording dots in each of the colors of Y, M and C will now be described in conjunction with FIGS. 2 to 6, FIGS. 7 to 11 and FIGS. 12 to 16. FIGS. 2, 7 and 12 show the arrangement of the image data. Also, FIGS. 3, 8 and 13 show the printing of recording dots formed with a printing gradation of 10 changed in the printing gradation numbers of 0 to 63. FIGS. 4, 9 and 14 show the printing of recording dots formed with a printing gradation of 20 changed in the printing gradation numbers of 0 to 63. FIGS. 5, 10 and 15 show the printing of recording dots formed with a printing gradation of 40 changed in the printing gradation numbers of 0 to 63. FIGS. 6, 11 and 16 show the printing of recording dots formed with a printing gradation of 60 changed in the printing gradation numbers of 0 to 63.

The vertical lattice lines of FIGS. 2 to 6, FIGS. 7 to 11 and FIGS. 12 to 16 represent dot formation positions of 300 dpi intervals for using a thermal head of 300 dpi according to the present embodiment, which dot formation positions are caused by the arrangement of heating resistors of the thermal head. Also, the lateral lattice lines are a lattice of 1,200 dpi which is obtained by dividing 300 dpi into fours in synchronism with a resolving power of the recording medium delivery. Namely, a single pixel (300 dpi×300 dpi) in the image construction is divided in fours in the sub-scanning direction to represent the arrangement positions of the dots to be arranged. In this specification, such a dot arrangement position is referred to as a sub-line. Also, the dot arrangement positions in which the main scanning direction×the sub-scanning direction is 300 dpi×300 dpi that is the basis for constructing the sub-line are called a main line.

The dot arrangement of Y according to the present invention will now be described with reference to FIGS. 2 to 6.

FIG. 2 shows the arrangement of the image data. The image data of Y to be printed and recorded are conceptionally arranged in the main line. FIGS. 3 to 6 show the actual printing recording dots. The image data shown in FIG. 2 actually form the printing recording dots in the arrangement positions shown in FIG. 3 through the thermal head driving controlling section to be described later. Incidentally, the dots 1 to 36 of FIG. 2 correspond to the associated dots of FIG. 3, respectively. For convenience' sake, the numbers of 1 to 36 are omitted in FIGS. 4 to 6.

As shown in FIGS. 3 to 6, the printing of recording dots is such that first recording dot groups which are printed on the same sub-line of at least two rows adjacent to each other in the main scanning direction (for example, the dot 4 of the first row and the dot 10 of the second row) are periodically arranged.

A first adjacent dot to be printed at a position separated by at least one sub-line in the same row in the main scanning direction and a single recording dot of the first recording dot group (for example, the dots 3 and 4 in the first row and the dot 10 in the second row or the dots 8 and 9 in the second row and the dot 15 in the third rod) are arranged so as to be printed to be in contact with or overlapped with each other when the gradation is high for the first recording dot group.

At the same time, a combination of another first recording dot group and another adjacent dot along with the combination of the first recording dot group and the first adjacent dot is formed and arranged to be separated by one or more subline, or one or more row (for example, like the dot group of the dots 3 and 4 in the first row and the dot 10 in the second row, and the dot 16 in the third row and the dot group of the dots 22 and 23 in the fourth row). This is called a Y recording dot group.

Furthermore, in the printing of recording dots, a single cycle is constituted by six lines (rows) in the main scanning direction and six lines in the sub-scanning direction as shown in FIGS. 2 to 6. This one cycle is formed repeatedly in the main scanning direction and the sub-scanning direction in order. The dots are arranged in the entire printing region corresponding to the image data (one image surface for Y).

The dot arrangement of M according to the present invention will now be described with reference to FIGS. 7 to 11.

FIG. 7 shows the arrangement of the image data. The image data of M to be printed and recorded are conceptionally arranged in the main line. FIGS. 8 to 11 show the actual printing of recording dots. The image data shown in FIG. 7 actually form the printing of recording dots in the arrangement positions shown in FIG. 8 through the thermal head driving controlling section to be described later. Incidentally, the dots 1 to 36 of FIG. 7 correspond to the associated dots of FIG. 8, respectively. For convenience' sake, the numbers of 1 to 36 are omitted in FIGS. 9 to 11.

As shown in FIGS. 7 to 11, in the printing of recording dots, the resolution both in the main scanning direction and in the sub-scanning direction are set at 300 dpi to thereby perform the regular one-dot staggered printing.

Furthermore, in the printing of recording dots (for example, the dots 1 and 2 in the first row and the dots 7 and 8 in the second row), one cycle is formed by four dots. Then, this cycle is repeated in the main scanning direction and the sub-scanning direction in order. The dots are arranged in the entire region (one image field of M) of the printing region corresponding to the image data. This is called M recording dots.

Incidentally, FIGS. 7 to 11 show the arrangement in which the recording dots are arranged repeatedly by three cycles in the main scanning direction and by three cycles in the sub-scanning direction.

The dot arrangement of C according to the present invention will now be described with reference to FIGS. 12 to 16.

FIG. 12 shows the arrangement of the image data. The image data of M to be printed and recorded are conceptionally arranged in the main line. FIGS. 13 to 16 show the actual printing of recording dots. The image data shown in FIG. 12 actually form the printing recording dots in the arrangement positions shown in FIG. 13 through the thermal head driving controlling section to be described later. Incidentally, the dots 1 to 36 of FIG. 12 correspond to the associated dots of FIG. 13, respectively. For convenience' sake, the numbers of 1 to 36 are omitted in FIGS. 14 to 16.

As shown in FIGS. 12 to 16, the printing of recording dots are arranged so that the average frequency of arranging the dots in each line in the main scanning direction is one dot per 300 dpi (main line). In the same row in the main scanning direction, respective recording dots of one odd line and one even line in the sub-scanning direction (like dots 1 and 2 in the first row) or the one even line and one odd line (like dots 8 and 9 in the second row) are formed at positions separated from each other by one or more sub-line to form the second recording dot group. In addition, in the rows adjacent in the main scanning direction, the dots are arranged so that the position where the second recording dot group is formed is different. For example, the formation positions of the dots 1 and 2 in the first row and the dots 8 and 9 in the second row are different from each other. This is called the C recording dot group.

Furthermore, in the printing recording dots, one cycle is formed by four dots of the dots 1, 2, 7 and 8. Then, this one cycle is repeated in the main scanning direction and the sub-scanning direction in order to arrange the dots in the entire region (one image field of C) of the printing region corresponding to the image data.

Incidentally, FIGS. 12 to 16 show the arrangement in which the recording dots are arranged repeatedly by three cycles in the main scanning direction and by three cycles in the sub-scanning direction.

In the description of the present embodiment, the printing recording dots of Y are formed as shown in FIGS. 3 to 6, the printing recording dots of K and M are formed as shown in FIGS. 8 to 11 and the printing recording dots of C are formed as shown in FIGS. 13 to 16. The correspondence relationship of the printing colors and the printing form of the printing recording dots is not limited to those.

Next, description will be made on the printing pulses for forming the printing recording dots of each color of Y, M and C shown in FIGS. 2 to 6, FIGS. 7 to 11 and FIGS. 12 to 16 on the basis of FIGS. 17, 18 and 19.

Figure 17:
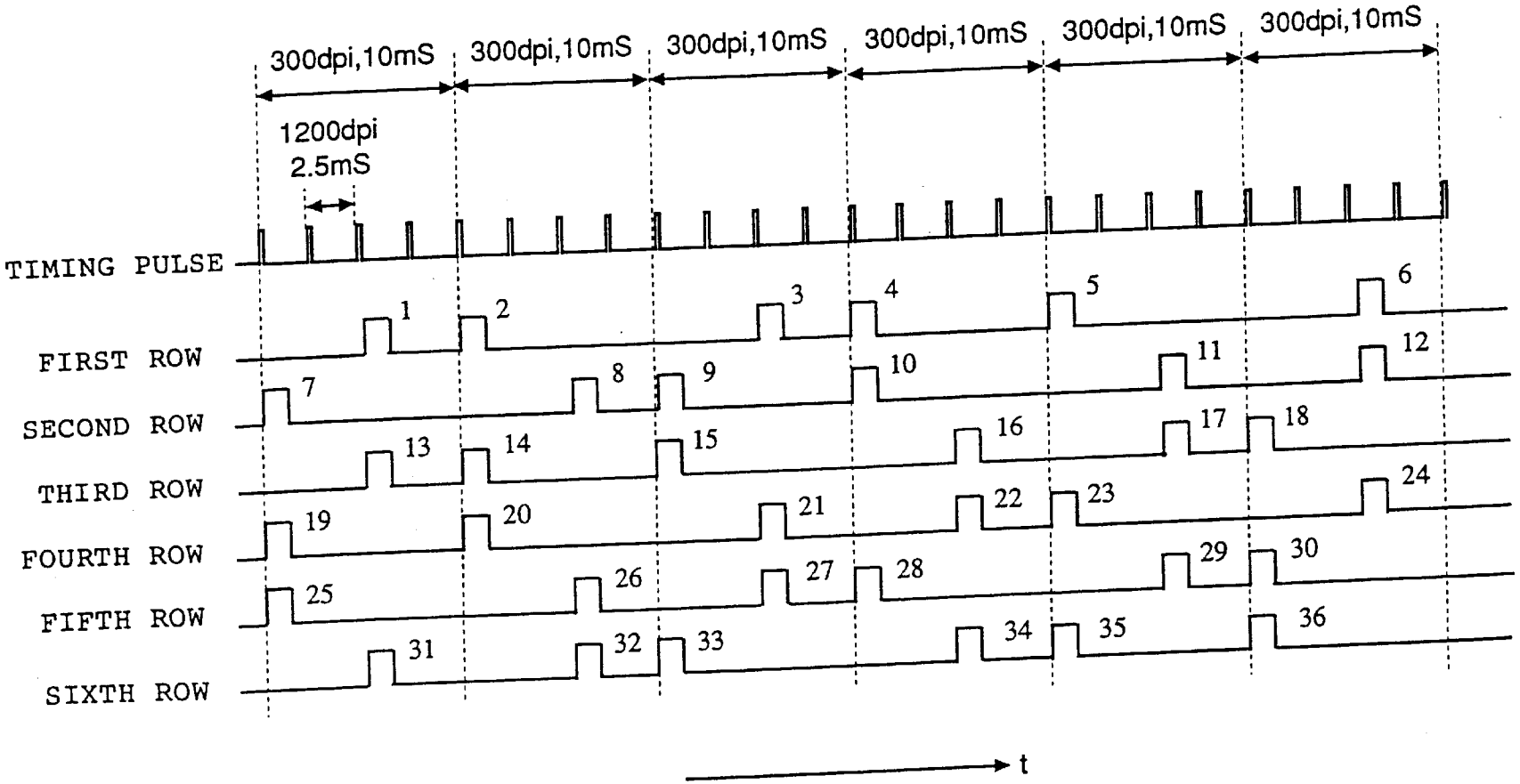
FIG. 17 is a view showing one example of the application pulses for forming the recording dots of Y color in accordance with the melting type color thermal transfer recording method to which the present invention is applied.
Figure 18:
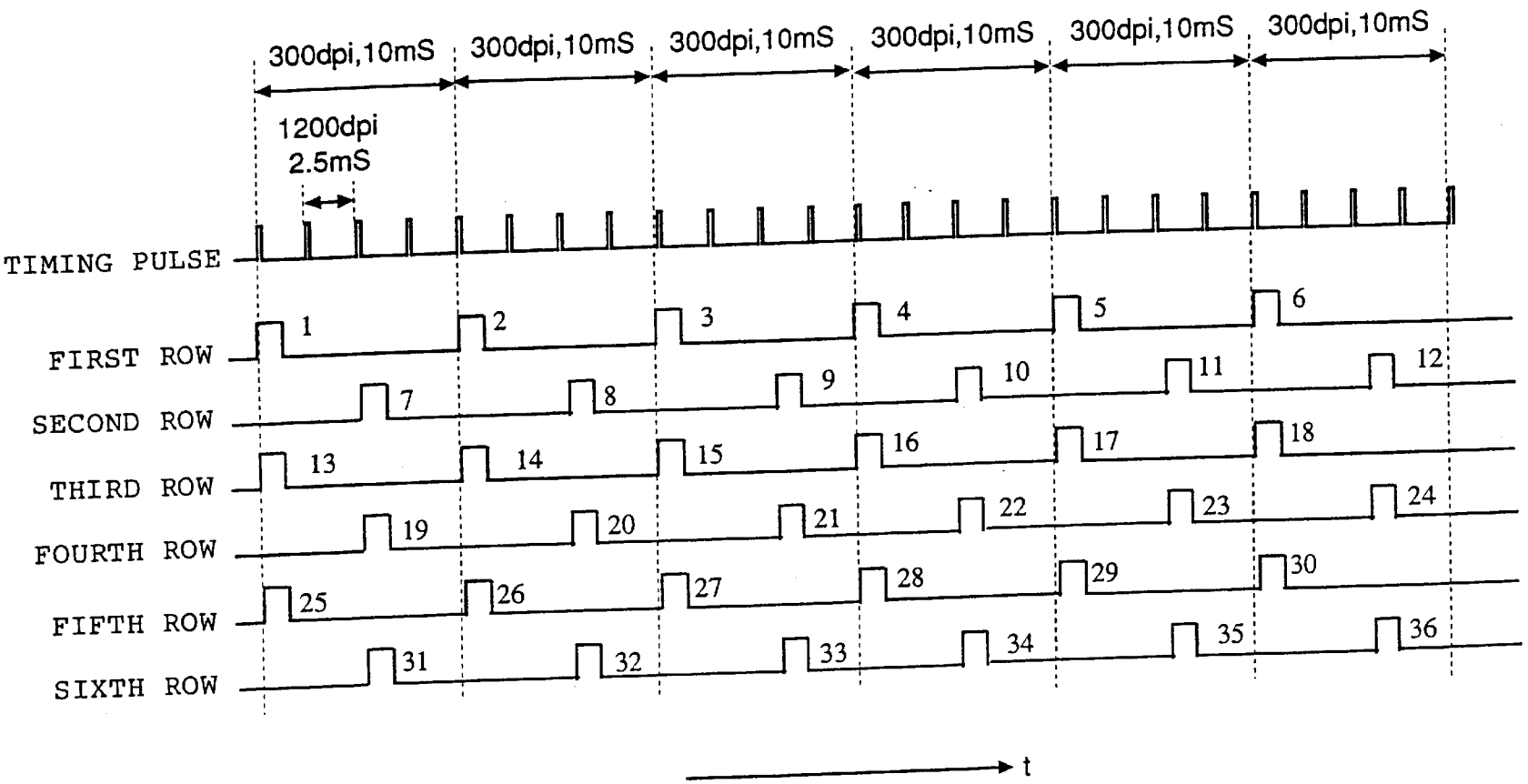
FIG. 18 is a view showing one example of the application pulses for forming the recording dots of M color in accordance with the melting type color thermal transfer recording method to which the present invention is applied.
Figure 19:
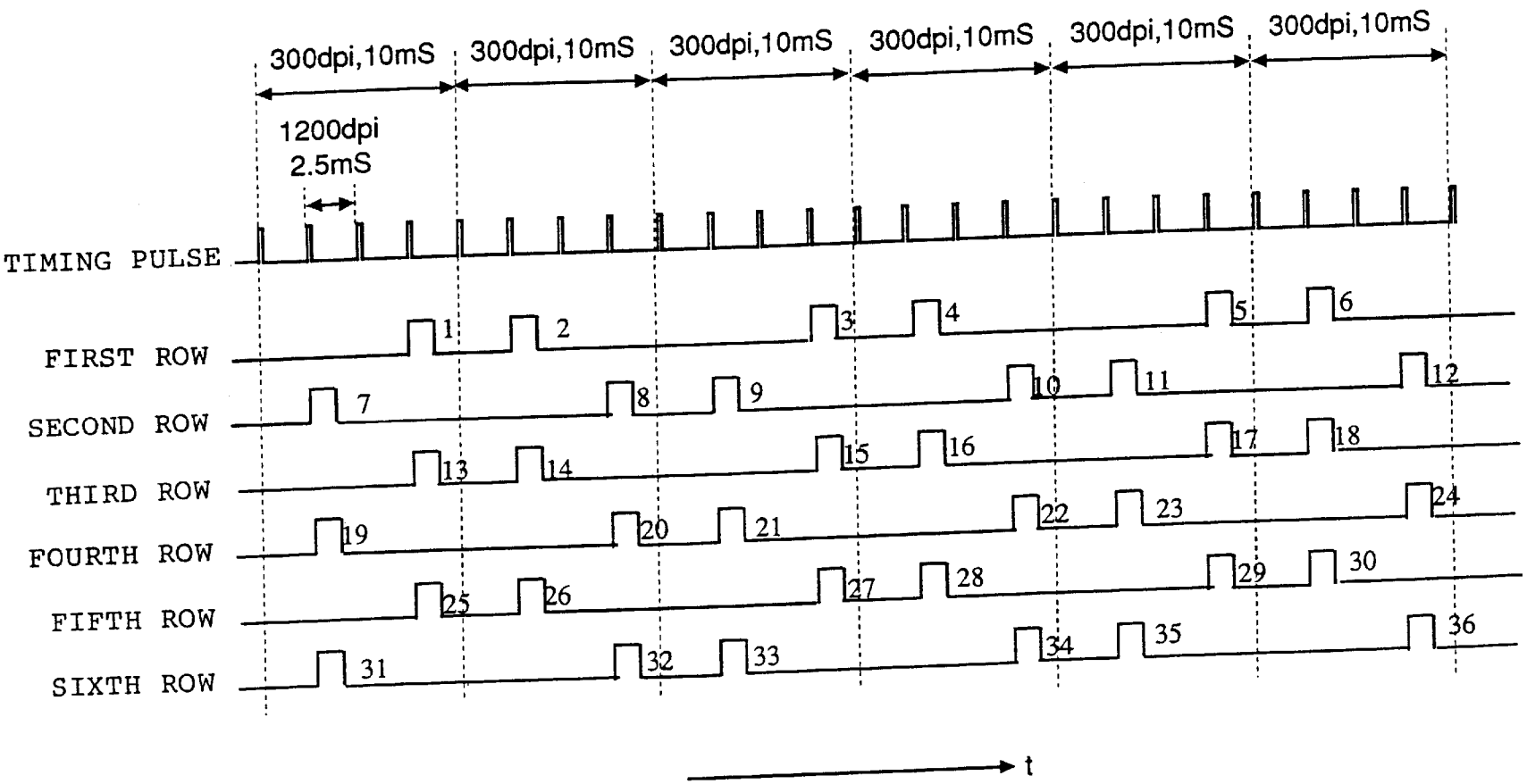
FIG. 19 is a view showing one example of the application pulses for forming the recording dots of C color in accordance with the melting type color thermal transfer recording method to which the present invention is applied.

The solid line portions of the pulse waveforms of FIGS. 17, 18 and 19 correspond to the arrangement and form of the printing recording dots of 60 gradations of FIGS. 6, 11 and 16, respectively and also correspond to the dot numbers 1 to 36. In order to avoid the complicated explanation, the explanation of the pulse waveform corresponding to the printing recording dots of 10, 20 and 40 gradations. Furthermore, FIG. 17 shows one cycle adjacent in the sub-scanning direction, FIG. 18 shows 6 cycles adjacent in the sub-scanning direction, and FIG. 19 shows 3 cycles adjacent in the sub-scanning direction. However, actually, the continuous dot form of FIG. 1 is realized by the repetition of the waveforms.

Now, in the four divisions with the basic printing speed of 10 ms, the following features are obtained experimentally from the relationship between the pulse (thermal application energy) of the thermal head and the ink transfer characteristics.

Feature 1: When the dots adjacent in the main scanning direction are formed simultaneously, the ink shapes of the simultaneously formed ink are combined with each other as the ink shapes become large. However, when the timings of the application pulses are displaced (i.e., displaced by one or more sub-lines) and the energy is not applied simultaneously, even if the ink shapes become large, the adjacent dots are not combined. However, in the high gradation printing (63 gradations) over 60 gradations, the adjacent ink shapes are overlapped with each other to form the fully combined dots.

Feature 2: When the dots are formed continuously in the sub-scanning direction, if the dot arrangement interval is equal to or less than the two sub-lines (i.e., Y recording dot group or C recording dot group), the ink shapes are combined as the ink shapes become large. However, when the interval exceeds this, even if the ink shapes are enlarged, the continuous dots are not combined. However, in the high gradation printing (63 gradations) over 60 gradations, the adjacent ink shapes are overlapped with each other to form the fully combined dots.

The printing pulses for forming the printing recording dots of Y according to the present invention shown in FIGS. 2 to 6 will first be described with reference to FIG. 17.

A dot forming method will be described in time sequence for each sub-line in the sub-scanning direction. First of all, the pulses are applied to the second, fourth and fifth rows to print the dots 7, 19 and 25. Subsequently, the recording medium is fed by two sub-lines (600 dpi), and the pulses are applied to the first, third and sixth rows to print the dots 1, 13 and 31. Subsequently, the recording medium is fed by two sub-lines, and the pulses are applied to the first, third and fourth rows to form the dots 2, 14 and 20. Subsequently, the recording medium is fed by two sub-lines, and the pulses are applied to the second, fifth and sixth rows to form the dots 8, 26 and 32. Subsequently, the recording medium is fed by two sub-lines and the pulses are applied to the second, third and sixth rows to form the dots 9, 15 and 33. Subsequently, the recording medium is fed by two sub-lines, the pulses are applied to the first, fourth and fifth rows to form the dots 3, 21 and 27. Subsequently, the recording medium is fed by two sub-lines, the pulses are applied to the first, second and fifth rows to form the dots 4, 10 and 28. Subsequently, the recording medium is fed by two sub-lines, and the pulses are applied to the third, fourth and sixth rows to form the dots 16, 22 and 34. Subsequently, the recording medium is fed by two sub-lines and the pulses are applied to the first, fourth and sixth row to form the dots 5, 23 and 35. Subsequently, the recording medium is fed by two sub-lines and the pulses are applied to the second, third and fifth rows to form the dots 11, 17 and 29. Subsequently, the recording medium is fed by two sub-lines and the pulses are applied to the third, fifth and sixth rows to form the dots 18, 30 and 36. Subsequently, the recording medium is fed by two sub-lines and the pulses are applied to the first, second and fourth rows to form the dots 6, 12 and 24.

Then, with respect to the dot shapes, as the dot shapes are enlarged as shown in FIGS. 3 to 5, the linkage of the dots are controlled by the above-described features 1 and 2. Namely, 3 and 4 and 10 or the like which are in the Y recording dot group are enlarged to be combined with each other.

The printing pulses for forming the printing recording dots of M according to the present invention shown in FIGS. 7 to 11 will first be described with reference to FIG. 18.

A dot forming method will be described in time sequence for each sub-line in the sub-scanning direction. First of all, the pulses are applied to the first, third and fifth rows to print the dots 1, 13 and 25. Subsequently, the recording paper is fed by two sub-lines (600 dpi), and the pulses are applied to the second, fourth and sixth rows to print the dots 7, 19 and 31. Subsequently, the recording medium is fed by two sub-lines, and the pulses are applied to the first, third and fifth rows to form the dots 2, 14 and 26. Subsequently, the recording medium is fed by two sub-lines, and the pulses are applied to the second, fourth and sixth rows to form the dots 8, 20 and 32.

Thereafter, in the same way, the dots are formed in the order of the odd row dots and the even row dots.

Then, with respect to the dot shapes, as the dot shapes are enlarged as shown in FIGS. 8 to 10, the linkage of the dots are controlled by the above-described features 1 and 2. Namely, the printing recording dots are enlarged without any linkage with the adjacent dots.

The printing pulses for forming the printing recording dots of C according to the present invention shown in FIGS. 12 to 16 will first be described with reference to FIG. 19.

A dot forming method will be described in time sequence for each sub-line in the sub-scanning direction. The recording paper is fed by one sub-line (1,200 dpi). First of all, the pulses are applied to the second, fourth and sixth rows to print the dots 7, 19 and 31. Subsequently, the recording paper is fed by two sub-lines (600 dpi), and the pulses are applied to the first, third and fifth rows to print the dots 1, 13 and 25. Subsequently, the recording medium is fed by two sub-lines, and the pulses are applied to the first, third and fifth rows to form the dots 2, 14 and 36. Subsequently, the recording medium is fed by two sub-lines, and the pulses are applied to the second, fourth and sixth rows to form the dots 8, 20 and 32.

Thereafter, in the same way, the dots are formed in the order of the even row dots, odd row dots, odd row dots and the even row dots.

Then, with respect to the dot shapes, as the dot shapes are enlarged as shown in FIGS. 13 to 15, the linkage of the dots are controlled by the above-described features 1 and 2. Namely, 1 and 2 or the like which are in the C recording dot group are enlarged so that they are combined with each other.

In the embodiment of the invention, the explanation has been given assuming that the gradation of each dot is the same. Of course, actually, the gradation is given to each dot as desired.

Also, in the description of the embodiment, the printing recording dots are formed in the same gradation for the recording data, a method for determining the dot printing gradation in contrast to the peripheral pixels is adopted by weighing all the dots with the distance from the ideal dot arrangement positions in view of a method for weighing the concentration distribution by weighing the distance to the dot distribution center, and further in view of the fact that the dot position where one pixel is arranged is different from each other.

FIG. 1 shows the thus determined dot arrangement pattern. When the three gray (Y+M+C) is noticed, since the ink overlapped portions and non-overlapped portions of the Y, M and C ink are arranged at random, even if the dot arrangement positions are microscopically displaced for each color due to the factors such as a mechanical problem, the displacement for compensating for the displacement occurs therearound. Accordingly, it is possible to macroscopically avoid the color moire.

Figure 20:
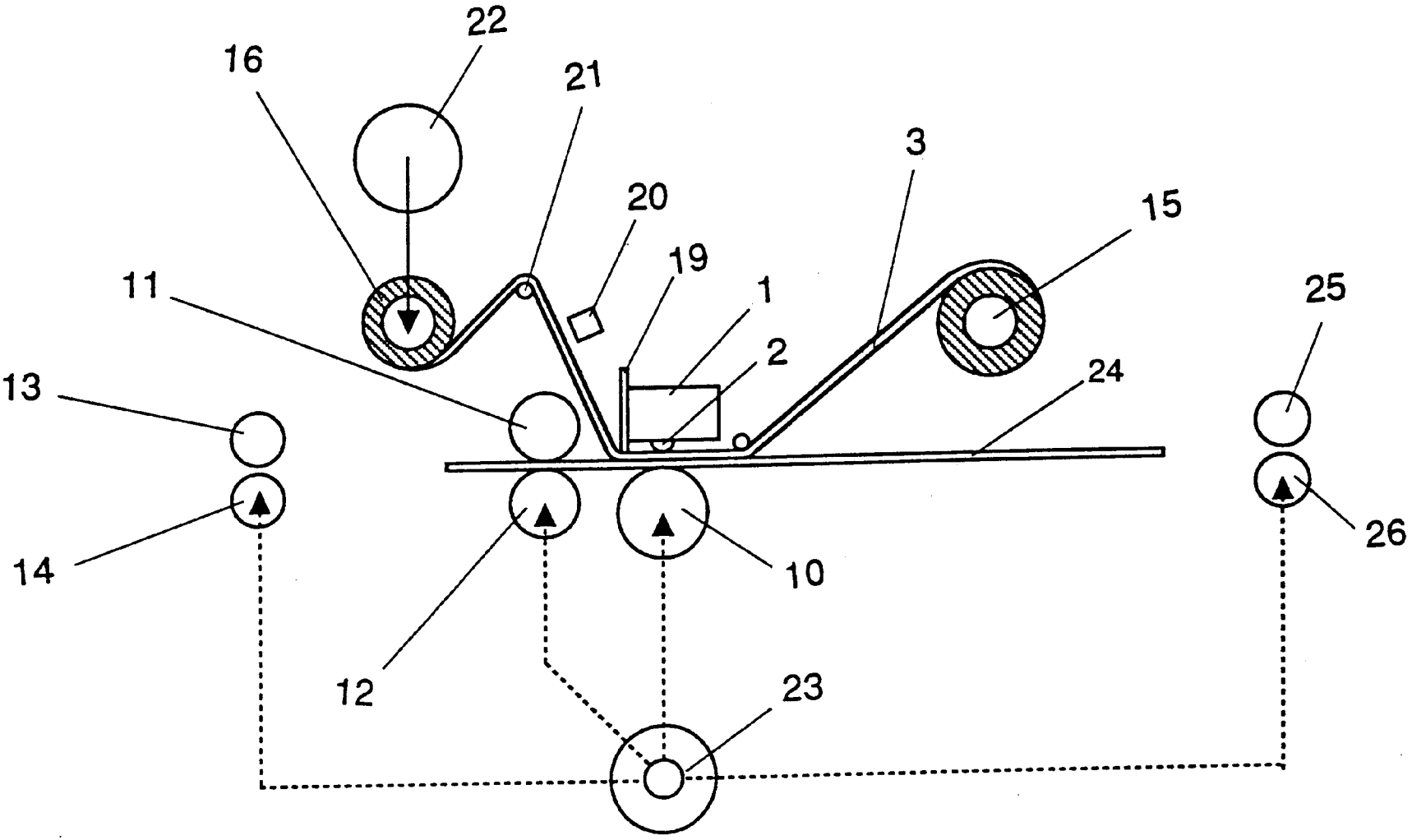
FIG. 20 is a view showing a schematic structure of a primary part of a melting type color thermal transfer recording apparatus to which the present invention is applied.

The means for obtaining the arrangement pattern of the recording dots as described above will hereafter be described. The schematic structure of the primary part of the melting type color thermal transfer recording apparatus used in the present invention is shown in FIG. 20.

A number (for example, 3,648) of heating resistors 2 are arranged in the main scanning direction in a row in a thermal head 1. Each heating resistor has a size of, for example, 68 $\mu$m in the main scanning direction and 80 $\mu$m in the sub-scanning direction. Then, the heating resistors 2 are arranged to face a platen roller 10. Also, the thermal head 1 is structured so as to be moved up and down by a drive mechanism (not shown) between a position where it presses an ink sheet 3 (FIG. 20 showing this position) and a position where it does not press the ink sheet.

The platen roller 10 and a pair of paper feeding rollers 11 and 12 are rotatable in a forward direction and a reverse direction in the sub-scanning direction by a stepping motor 23 that is controlled by a controller (not shown) for feeding the thermal transfer paper 24 that is the recording medium. A pair of paper picking-up rollers 25 and 26 and the paper guide (not shown) for feeding the paper to the platen roller 10 are arranged upstream of the platen roller 10. Also a pair of paper discharge rollers 13 and 14 and the paper discharge guide (not shown) are arranged downstream of paper feeding rollers 11 and 12. The paper picking-up rollers 25 and 26 and the paper discharge rollers 13 and 14 are together rotatable in the sub-scanning direction by the stepping motor 23 controlled by the controller (not shown) for feeding the thermal transfer paper 24.

Furthermore, an ink sheet feeding roller 15 and an ink sheet winding roller 16 are provided. The ink sheet winding roller 16 is rotatable by a DC motor 22 that is controlled by the controller (not shown). A peel plate 19 for peeling the ink sheet 3 and the transfer paper 24 after the thermal transfer from each other in a stable manner is disposed at an end of the thermal head 1 on the side of the ink sheet winding roller 16. Furthermore, in order to keep the peel angle unchanged even if the size of the diameter on the winding side is changed by the winding the ink sheet 3, an ink sheet guide roller 21 is interposed between the peel plate 19 and the ink sheet winding roller 16. Then, an ink sheet sensor 20 is disposed in the vicinity of the ink sheet guide roller 21.

Figure 21A:
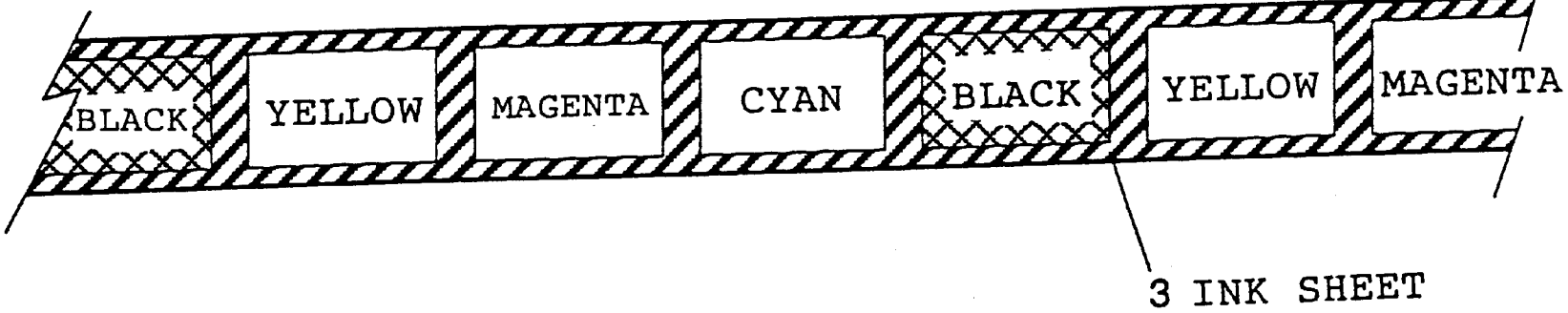
FIGS. 21A and 21B are a top view and a side view of an ink sheet.
Figure 21B:
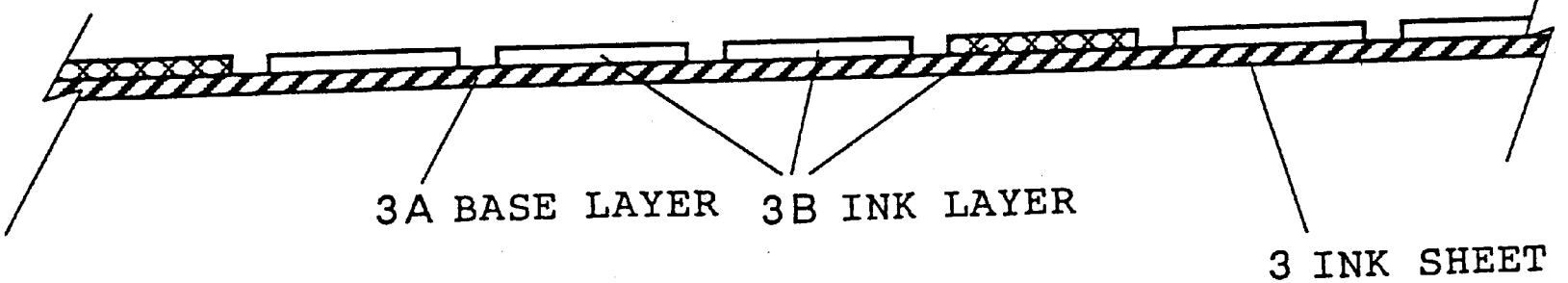

As shown in FIG. 21, an ink layer 3B of thermally melting type ink which contains, as main material, wax containing pigments on a base layer 3A composed of PET (polyethylene terephthalate) film or the like are coated for every one image field in the order of Y, M, C and K. With the ink sheet 3, it is possible to switch the colors facing the thermal head 1 in the order of Y, M, C and K by rotating the ink sheet winding roller 16. A pattern (not shown) is given in the vicinity of the ink layer of each color for identifying the color of the ink layer with an ink sheet sensor 20.

Figure 22:
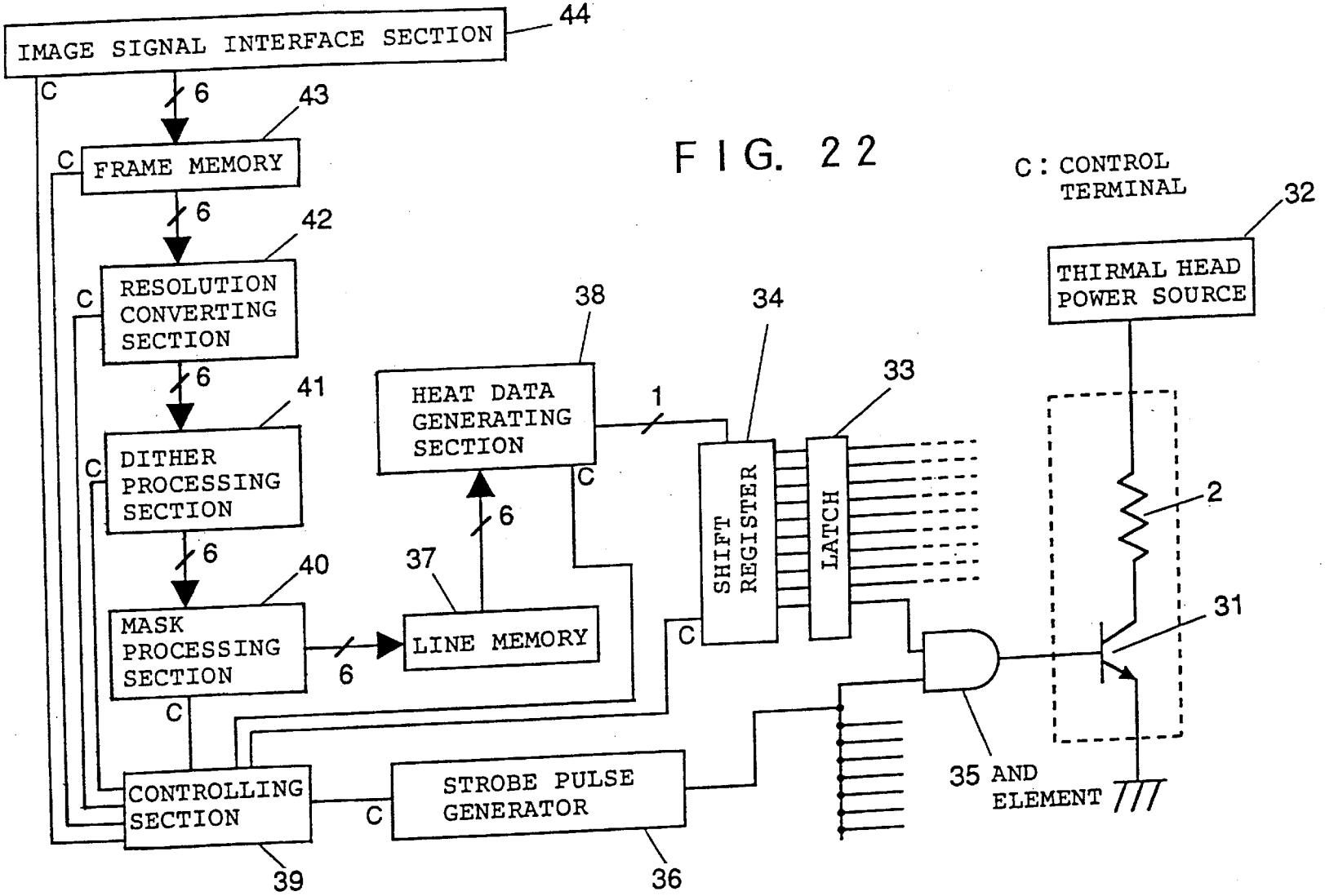
FIG. 22 is a block diagram showing a structure of a thermal head drive controlling section.

FIG. 22 is a block diagram showing the structure of the thermal head drive controlling section. A switching element constituted by a transistor 31 and a thermal head power source 32 are connected in series with the heating resistors 2 of the thermal head. Under the condition that the transistor 31 is turned on, the current is supplied from the thermal head power source 32 to the heating resistors 2.

An image signal interface section 44 receives the image data written by a postscript or the like from a host computer (not shown), and feeds, to a frame memory 43 in the order of the fields of Y, M, C and K, the image data having the 6 bit gradations for each dot, with 3,648 dots×5,400 dots at maximum with the resolution of 300 dpi×300 dpi in the main scanning direction×the sub-scanning direction.

The frame memory 43 reads out the stored image data by the predetermined number of the lines for each color and feeds them to a resolution converting section 42. The resolution converting section 42 converts the resolution in the sub-scanning direction into a predetermined resolution in correspondence with the color of the image data. In the embodiment, the method for determining the dot printing gradation in contrast to the peripheral pixels is carried out by weighing all the dots with the distance from the ideal dot arrangement positions in view of a method for weighing the concentration distribution by weighing the distance to the dot distribution center, and further in view of the fact that the dot position where one pixel is arranged is different from each other.

In the dither processing section 41, the dither matrix of 2×2 is overlapped on the image data having the 64 gradation to thereby nominally obtain the image data of 256 gradations for each color. In a mask processing section 40, a mask pattern shown in FIGS. 23 to 25, respectively, for Y, M and C in correspondence with the colors of the image data to be printed is selected and performs the mask process to the image data. A line memory 37 may store the data corresponding to, for example, four lines and newly stores the data of one line for every use of the data of one line. Namely, the number of the lines in the sub-scanning direction is increased in the resolution converting section 42. The dot of the increased line number is selected in the mask processing section 40 so that the dot formation timing in the sub-scanning direction is set.

A heat data generating section 38 refers to the data in the line memory 37 and judges whether or not the gradation of each dot is one or more or less. If it is one or more, the heat data of "1" is generated, or if it is less than one, the data of "0" is generated. Then, the heat data are generated for all the dots in one line, and are to be fed serially to shift register 34. The heat data corresponding to one line written in the shift register 34 are written in parallel in a latch 33 in synchronism with a portion of the gradation 1 of a strobe pulses generated by the strobe pulse generator 36. Since the portion of the gradation 1 of the strobe pulse of an AND element 35 is kept at a high level, and the AND turns the transistor 31 on during the period when the heat data held in the latch 33 is at "1", the current is fed from the thermal head power source 32 to the heating resistors 2 during this period. This process is executed from the gradation 1 to 63 to complete the printing of the image data for one line.

After the printing of the image data for one line has thus completed, the printing is performed in the same manner for all the lines, so that the single color printing is performed for the image on the single sheet. Then, the printing of four colors in the order of image fields is performed to thereby complete the recording of the color image on the single sheet. The thermal head controlling section described above is controlled in sequence by the controlling section 39. The order of printing has been described as the order of Y, M, C and K. However, the present invention is not limited to this.

The operation of the melting type color transfer recording apparatus will now be described.

In FIG. 22, the host computer (not shown) feeds the signal representative of the instruction of the printing operation start to the thermal transfer recording apparatus to thereby start the printing operation of the thermal transfer recording apparatus. At the same time, the image data signal fed from the host computer (not shown) is stored in the frame memory 43 through the image signal interface section 44.

In this case, the image data to be fed from the host computer to the image signal interface section 44 are the digital signals, and have 6 bit width for one color. The application of the present invention is not limited to this.

The image signal to be fed from the host computer to the thermal transfer recording apparatus is the RGB image in some cases or the C, M, Y and K image composed of the image data of four colors of C, M, Y and K. Also, in some cases, the resolution is one other than 300 dpi. Accordingly, the image signal interface section 44 converts the data into the C, M, Y and K image in the case where the fed image is the RGB image, and converts the data into the image of 300 dpi by using the enlargement/reduction function in the case where the resolution is one other than 300 dpi and thereafter writes the data into the frame memory 43. Namely, the image data signals to be written in the frame memory 43 from the image signal interface section 44 are the CMYK data or of course the digital signals.

In FIG. 20, a piece of the thermal transfer recording paper 24 disposed on the paper guide (not shown) is introduced into an apparatus by the rotation of the paper picking-up rollers 25 and 26 in parallel with the transfer of the image data. At the moment when the thermal transfer recording paper 24 is fed at the position of the paper feeding rollers 11 and 12, the paper feeding operation thereafter is carried out mainly by the paper feeding rollers 11 and 12. Where a forward portion corresponding to about ten lines from the printing start line of the thermal transfer recording paper 24 has been fed below the heating resistors 2 of the thermal head, the feeding operation is once stopped. Subsequently, the ink sheet 3 is taken up by the rotation of the ink sheet winding roller 16. The winding operation of the ink sheet is once stopped at the stage when the ink sheet sensor 20 detects the ink layer of Y on the ink sheet 3. The thermal head 1 is moved downwardly. The printing start line portion of the thermal transfer recording paper 24 and the ink sheet 3 are clamped between the heating resistors 2 and the platen roller 10 for waiting for the printing start instruction from the controller.

When the storing operation of the image data of Y corresponding to the image field, to be printed, to the frame memory 43 has been completed, the resolution converting section 42 receives the image data by every one line or every several lines from the frame memory 43 to execute the resolution process and to thereafter feed it to the dither processing section 41. In the dither processing section 41, the image data having nominal 256 gradations are made by using the dither matrix of 2×2 for the 6 bit image data. In the mask processing section 40 that receives the image data, the image data that have been subjected the mask process by using the mask pattern corresponding to the dots to be printed are fed to the line memory 37.

The mask patterns of Y, M and C will now be described with reference to FIGS. 23 to 25, respectively.

Figure 23:
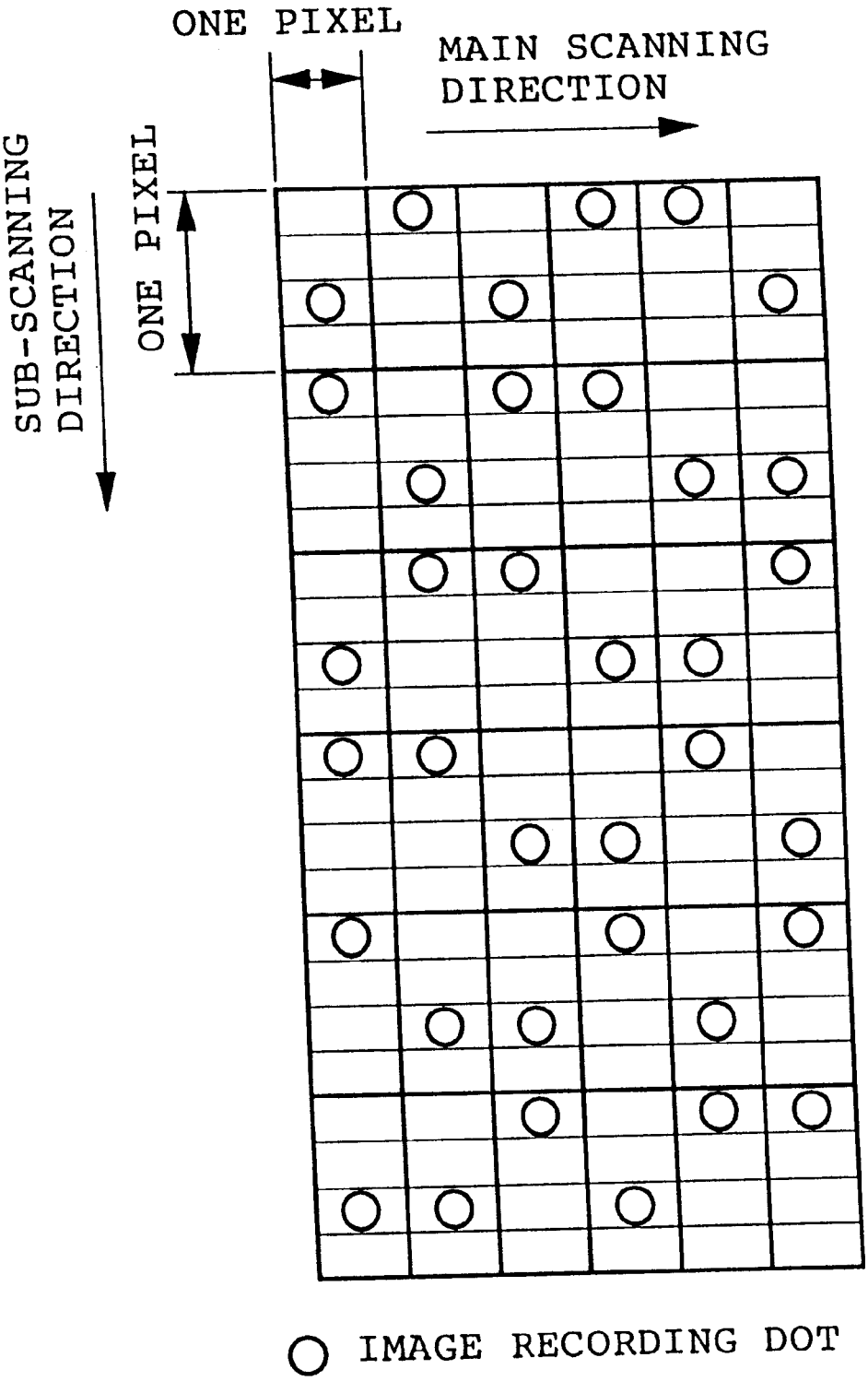
FIG. 23 is a view showing one example of a mask pattern used in a resolution converting section of FIG. 22.
Figure 24:
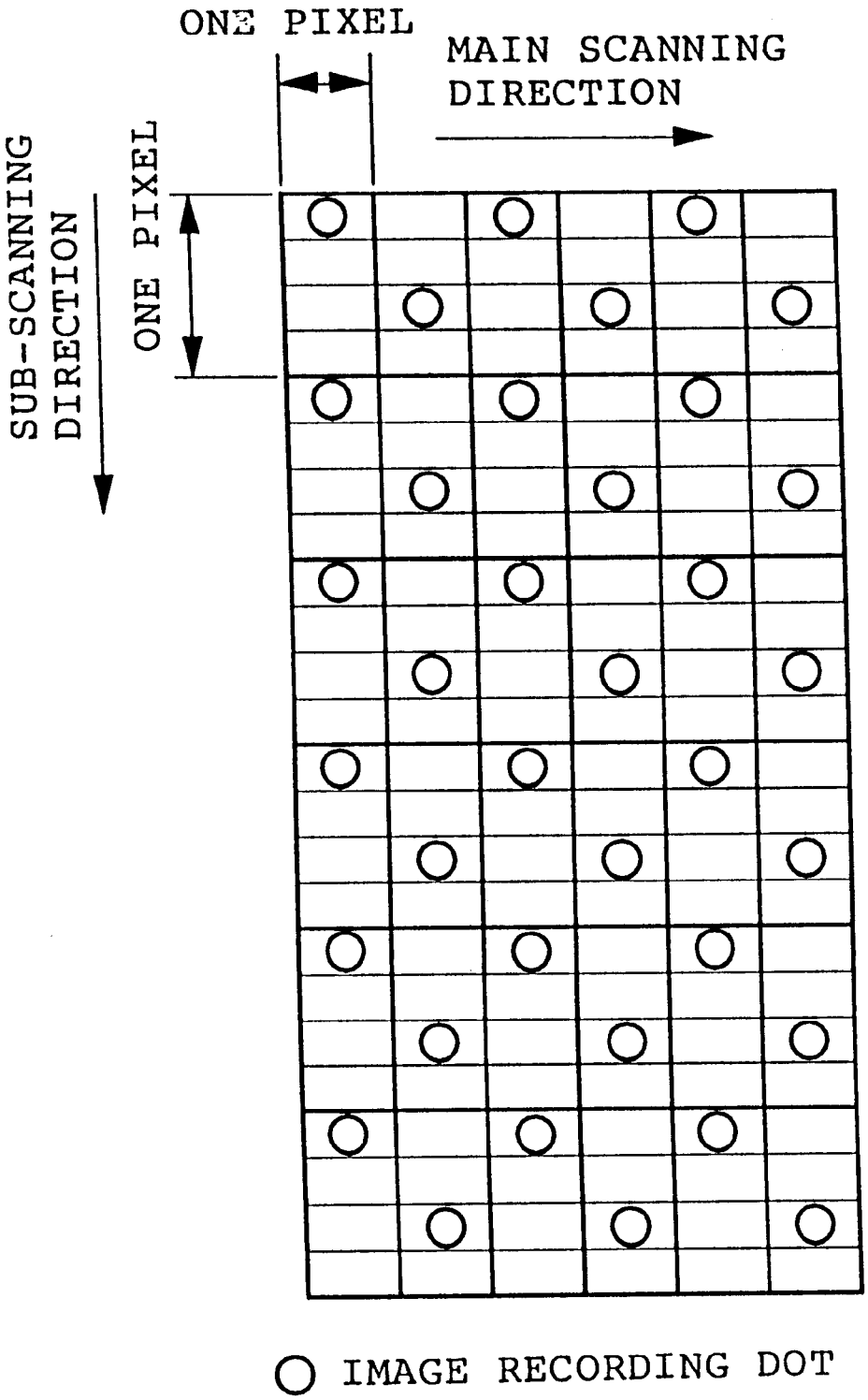
FIG. 24 is a view showing another example of a mask pattern used in the resolution converting section of FIG. 22.
Figure 25:
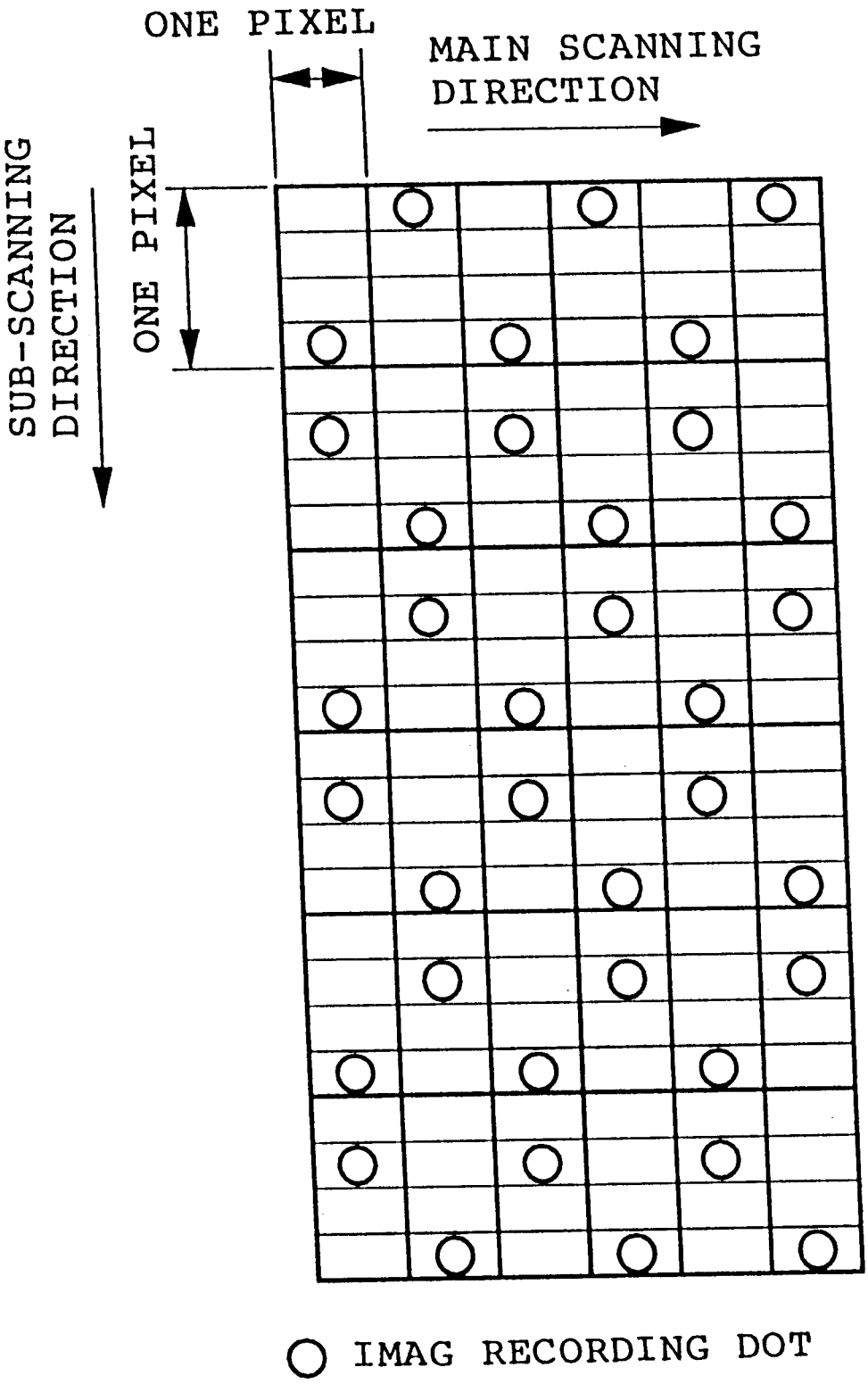
FIG. 25 is a view showing another example of a mask pattern used in the resolution converting section of FIG. 22.

In FIGS. 23 to 25, since the vertical lines of the matrix correspond to the dots in the main scanning direction, and the lateral directional ones are obtained by dividing one pixel in the sub-scanning direction into four and forming them as sub-lines, the pixels of 6×6 (scanning direction× sub-scanning direction) that form the printing are converted into the dot arrangement pattern 6×6 and are masked to define the dot positions.

The mask pattern shown in FIG. 23 is used for the printing recording dots of Y according to the embodiment corresponding to the arrangement of the printing recording dots shown in FIG. 3.

The mask pattern shown in FIG. 24 is used for the printing recording dots of M according to the embodiment corresponding to the arrangement of the printing recording dots shown in FIG. 8.

The mask pattern shown in FIG. 25 is used for the printing recording dots of M according to the embodiment corresponding to the arrangement of the printing recording dots shown in FIG. 13.

It is possible to control the printing pattern by selecting these pattern in accordance with the printing color as desired and using them by changing the mask pattern. Namely, the present invention is not limited to the above-described relationship between the colors and the dot arrangement positions. Furthermore, the dot arrangement positions are not limited to the above-described mask patterns.

The heat data generating section 38 binary-codes all the pixels of one line stored in the line memory 37 for every gradation and transfers them to the shift register 34. In the specific process of the heat data generating section 38, first of all, the pixel portion having the gradation of one or more is fed as "1" and other portion is fed as "0" to the shift register 34 for the gradation level of the image data stored in the line memory 37.

The number of the shift registers 34 corresponds to the number of the dots which is the same (for example, 3,648) as that of the heat resistors 2. At the stage when the transfer to the shift registers 34 has been completed, the heat data are latched in parallel in the latched 33. Upon the latch, the heat data generating section 38 starts the transfer to the shift registers 34 in the same manner by coding the pixel portion of gradation of two or more as "1" with respect to the first line of Y. At this time, since the printing preparation has been completed, the paper feeding rollers 11 and 12 and the platen roller 10 start the delivery of the thermal transfer recording paper 24, and at the same time, the ink sheet winding roller 16 starts the winding of the ink sheet 3. In synchronism with these, the strobe pulse generating section 36 generates the strobe signals.

During the period when the strobe pulse corresponding to the gradation of one is one, the base of the transistor 31 of the heating resistor 2, in which the output (heat data in gradation 1) of the latch 33 is 1, is kept at a high level, and the heating resistor 2 is subjected to the current flow to generate the heat so that the ink is transferred to the thermal transfer recording paper 24. Until the strobe signals in the gradation 1 are finished, in the heat data generation section 38, the heat data in which the pixel portion of gradation 2 or more for the gradation data of the first line of Y are transferred to the shift register 34, and the data are latched at the moment when the strobe signals of gradation 1 are finished. Then, the latch is completed and at the same time, the strobe pulse generation section 36 generates the strobe pulses during the period corresponding to the gradation 2. In the meanwhile, subsequent to the case where the base of the transistor 31 of the heating resistor 2 in which the output (heat data of gradation 2) of the latch 33 is 1 is kept in gradation 1, the high level is kept so that the heating resistor 2 is kept continuously in the current flow condition to generate the heat to transfer the ink further to the thermal transfer recording paper 24.

These operations are repeatedly performed in the order of gradations 3, 4, 5, . . . , 61, 62 and 63 for the data corresponding to the first line of Y stored in the line memory 37.

Thus, after the printing corresponding to the first line of Y has been completed, the data that have not yet been converted and are necessary for printing for the next line are read out from the frame memory 43. The data of the second line are stored in the line memory 37 through the resolution converting section 42, the dither processing section 41 and the mask processing section 40. The heat data generating section 38 reads out the gradation data of the second line of Y out of the line memory 37 and binary-codes data for all the pixels of the second line in the same manner as for the first line to transfer them to the shift register 34 as the serial data. When the heat data of gradation 1 in the second line of Y are latched and the delivery distance of the thermal transfer recording paper 24 is 21.2 $\mu$m for 2.5 msec in terms of time from the printing start of the first line of Y, the heating resistor 2 is subjected to the current flow by the strobe pulses of gradation 1 of the second line of Y to thereby transfer the ink. Thereafter, in the same manner as in the first line, the operations are executed in the order of the gradation levels of 2, 3, 4, 5, . . . , 61, 62 and 63.

When the printing has been thus completed up to the final line of Y, and the final line portion of the thermal transfer recording paper 24 is peeled, the thermal head 1 is moved upwardly, and at the same time, the rotation of the ink sheet winding roller 16 is stopped. Subsequently, by rotating in the reverse direction the paper feeding rollers 11 and 12 and the platen roller 10, the thermal transfer recording paper 24 is returned back to the recording section where the forward portion corresponding to about ten lines from the printing start line is clamped by the heating resistors 2 and the platen roller 10. Also, by the rotation of the ink sheet winding roller 16, the ink sheet 3 is fed until the ink sheet sensor 20 detects the ink layer of M on the ink sheet 3.

Then, at the time when the ink layer of M is detected, the winding operation of the ink sheet is once stopped, and the thermal head 1 is moved down to the position shown in FIG. 20 for waiting for the printing start instruction of the image data of M from the controller (not shown). The sequence of the image data of M is essentially the same as that of the image data of Y thus far described. In this embodiment, there is only a difference in mask pattern of FIGS. 23 to 25. When the printing corresponding to the final line of M has been completed and final line portion of the thermal transfer recording paper 24 is peeled in the same manner as in Y, the thermal head 1 is moved upwardly and at the same time, the rotation of the ink sheet winding roller 16 is stopped. Subsequently, the paper feeding rollers 11 and 12 and the platen roller 10 are rotated in the reverse direction so that the thermal transfer recording paper 24 is returned back to the recording portion where the forward portion corresponding to about ten lines from the printing start line is clamped between the heating resistors 2 and the platen roller 10. Also, at the same time, by the rotation of the ink sheet winding roller 16, the ink sheet 3 is fed until the ink sheet sensor 20 detect the ink layer of C on the ink sheet 3.

Basically the same operation is repeated also for the printing of C and K thereafter. Also, the difference in printing operation between Y and M is only in mask pattern of FIGS. 23 to 25. When this is completed, the thermal head 1 is moved upwardly, and the rotation of the ink sheet winding roller 16 is stopped. Subsequently, by rotating the paper discharge rollers 13 and 14 and the paper feeding rollers 11 and 12, the transfer paper 24 is discharged to the outside of the apparatus to thereby complete the recording operation of a single piece of color image.

Also, the embodiment is related to the melting type color thermal transfer printer. However, the present invention may be applied to a sublimation type color thermal transfer printer, a TA (thermoautochrome) printer, a color laser printer, a color ink jet printer or the like. Furthermore, although the embodiment is related to the line printer, the present invention may be applied to a serial printer.

As described above in detail, according to the present invention, it is possible to effectively suppress the color fringe in a color image recording apparatus in which the recording dots of at least three kinds of color are formed. The effect of the present invention is remarkable in the case where the gradation expression is exhibited by the area of the recording dots.

What is claimed is:

1. A color image recording method in which recording dots having at least three different colors are printed on a recording medium in a plurality of lines of recording dots each extending in a main scan direction and a plurality of rows of recording dots each extending in a sub-scan direction, each line being divided into a predetermined number of lines in the sub-scanning direction to form sub-lines, and printing of dots is effected in a respective sub-line for every line in the sub-scanning direction; wherein recording dots of a first one of the colors are arranged so that the number of the sub-lines between a respective recording dot and another recording dot immediately before the respective recording dot in the sub-scanning direction is always different from the number of sub-lines between the respective recording dot and another recording dot immediately after the respective recording dot in the sub-scanning direction; and in adjacent rows in the main scanning direction, the recording dots are formed so that repeating phases of the recording dots differ from each other.

2. A color image recording method in which recording dots having at least three different colors are printed on a recording medium in a plurality of lines of recording dots each extending in a main scan direction and a plurality of rows of recording dots each extending in a sub-scan direction, each line being divided into a predetermined number of lines in a sub-scanning direction to form sub-lines, and a one-dot methods of printing is effected in a respective sub-line for every line in the sub-scanning direction, the method comprising the steps of forming a plurality of lines of recording dots of a first color according to a rule wherein a plurality of first recording dot groups each comprising a pair of adjacent recording dots printed in the same sub-line in two adjacent rows in a main scanning direction are arranged periodically throughout a printing region;

forming a recording dot adjacent to one of the recording dots in each of the first recording dot groups so that the recording dots of the first recording dot groups and the adjacent dots are in contact with each other or overlapped with each other when printing gradation is high;

arranging the recording dots of the first color so that a combination of a respective first recording dot group and the adjacent dot along with a combination of another first recording dot group and another adjacent dot are formed to be separated by one or more sub-lines or one or more rows;

forming a plurality of lines of recording dots of a second color according to a rule wherein with respect to recording dots printed in the same row in the main scanning direction, one odd number line and one even number line in the sub-scanning direction are formed to be separated by one sub-line or more to form a second recording dot group, and in adjacent rows in the main scanning direction, positions where the second recording dot group is formed are different from each other; and forming a plurality of lines of recording dots for a third color so that the recording dots are formed in accordance with a rule different from that of the first and second colors.

3. A color image recording method according to claim 1; wherein the recording dots are formed by transferring one of thermally melting type ink and thermally sublimation type ink on an ink sheet on the recording medium by heat generated by heating elements.

4. A color image recording apparatus in which recording dots of at least three different colors are printed on a recording medium, comprising:

a plurality of recording elements;

delivery means for delivering the recording medium to the recording elements;

energy application means for applying energy to the recording elements in correspondence with image data so that recording dots of the at least three colors are formed on a recording medium in a plurality of lines of recording dots each extending in a main scan direction and a plurality of rows of record dots each extending in a sub-scan direction, each line being divided into a predetermined number of lines in a sub-scanning direction to form sub-lines, and for printing of recording dots in a respective sub-line for every line in the sub-scanning directions;

wherein recording dots of at least one of the colors are arranged so that the number of the sub-lines between a respective recording dot and a recording dot immediately before the respective recording dot in the sub-scanning direction is always different from the number of sub-lines between the respective recording dot and a recording dot immediately after the respective recording dot in the sub-scanning direction, and the energy is applied to form the recording dots so that adjacent rows in the main scanning direction are different from each other in repeated phases.

5. A color image recording apparatus in which recording dots having at least three different colors are printed on a recording medium, comprising:

a plurality of recording elements;

delivery means for delivering the recording medium to the recording elements;

and energy application means for applying energy to the recording elements in correspondence with image data so that recording dots of the at least three colors are formed on a recording medium in a plurality of lines of recording dots each extending in a main scan direction and a plurality of rows of record dots each extending in a sub-scan direction, each line being divided into a predetermined number of lines in a sub-scanning direction to form sub-lines, and for printing the recording dots so that printing is effected in a respective sub-line for every line in the sub-scanning direction;

wherein recording dots of a first color are printed according to a rule wherein a plurality of first recording dot groups each comprising a pair of adjacent recording dots printed in the same sub-line in two adjacent rows in a main scanning direction are arranged periodically throughout a printing region, and a recording dot adjacent to one of the recording dots in each of the first recording dot groups is printed so that the recording dots of the first recording dot groups and the adjacent dots are in contact with each other or overlapped with each other when the gradation is high; and a combination of a respective first recording dot group and the adjacent dot along with a combination of another first recording dot group and another adjacent dot is arranged so as to be separated by one or more sub-lines or one or more rows;

recording dots of a second color are printed according to a rule wherein with respect to recording dots printed in the same row in the main scanning direction, one odd number line and one even number line in the sub-scanning direction are formed to be separated by one sub-line or more to form a second recording dot group, and in adjacent rows in the main scanning direction, positions where the second recording dot group is formed are different from each other; and recording dots for a third color are printed so that energy is applied so that the recording dots are formed in accordance with a rule different from that of the first and second colors.

6. A color image recording apparatus according to claim 4; wherein the recording dots are formed by one of transferring thermally melting type ink and thermally sublimation type ink on an ink sheet on the recording medium by heat generated by the recording elements.

7. A color image recording controlling method in which recording dots having at least three different colors are printed on a recording medium in a plurality of lines of recording dots each extending in a main scan direction and a plurality of rows of recording dots each extending in a sub-scan direction, each line being divided into a predetermined number of lines in a sub-scanning direction to form sub-lines, and the timing of applying a current to heating elements for forming one dot printing in a respective sub-line for every line is displaced in the sub-scanning direction; wherein the timing of applying current to the heating elements to form a plurality of lines of recording dots of one of the colors is controlled so that the number of the sub-lines between a respective recording dot and another recording dot immediately before the respective recording dot in the sub-scanning direction is always different from the number of sub-lines between the recording dot and a recording dot immediately after the respective recording dot in the sub-scanning direction, and in adjacent rows in the main scanning direction, the recording dots are formed so that repeating phases of the recording dots differ from each other.

8. A color image recording controlling method in which recording dots having at least three different colors are printed on a recording medium in a plurality of lines of recording dots each extending in a main scan direction and a plurality of rows of recording dots each extending in a sub-scan direction, each line being divided into a predetermined number of lines in a sub-scanning direction to form sub-lines, and the timing of applying a current to heating elements for forming one dot printing in a respective sub-line for every line is displaced in the sub-scanning direction; comprising the steps of controlling the timing of applying current to the heating elements to form a plurality of lines of recording dots of a first color according to a rule wherein a plurality of first recording dot groups each comprising a pair of adjacent recording dots printed in the same sub-line in two adjacent rows in the main scanning direction are arranged periodically throughout a printing region;

a recording dot adjacent to one of the recording dots in each of the first recording dot groups is printed so that the recording dots of the first recording dot groups and the adjacent dots are in contact with each other or overlapped with each other when printing gradation is high;

a combination of a respective first recording dot group and the adjacent dot along with a combination of another first recording dot group and another adjacent dot is arranged so as to be separated by one or more sub-lines or one or more rows;

controlling the timing of applying current to the heating elements to form a plurality of lines of recording dots of a second color according to a rule wherein with respect to recording dots printed in the same row in the main scanning direction, one odd number line and one even number line in the sub-scanning direction are formed to be separated by one sub-line or more to form a second recording dot group, and in adjacent rows in the main scanning direction, positions where the second recording dot group is formed are different from each other; and controlling the timing of applying current to the heating elements to form a plurality of lines of recording dots of a third color are formed so that the recording dots are formed in accordance with a rule different from that of the first and second colors.

9. A color image recording controlling method according to claim 7; wherein the recording dots are formed by one of transferring thermally melting type ink and thermally sublimation type ink on an ink sheet on the recording medium by heat generated by heating elements.

10. A color image recording method according to claim 1; wherein the recording dots of the first through third colors are formed by transferring a heat meltable ink of a corresponding color disposed on an ink sheet onto the recording medium through the use of heat generated by a heat generating element.

11. A color image recording method according to claim 1; wherein the first through third colors comprise yellow, magenta and cyan.

12. A color image recording method according to claim 1; wherein the recording dots of the first through third colors are formed with the same disposition pitch between respective lines of recording dots and respective rows of recording dots.

13. A color image recording method according to claim 12; wherein the disposition pitch between respective lines and rows of recording dots is 84.7 $\mu$m.

14. A color image recording method according to claim 1; wherein alternate rows of the recording dots are shifted in the sub-scan direction by ½ the disposition pitch between respective lines of the recording dots.

15. A color image recording apparatus according to claim 4; wherein the recording elements comprise heat generating elements disposed in a line in the main scan direction in a thermal head for printing a line of record dots.

16. A color image recording apparatus according to claim 15; further comprising a platen roller disposed opposite the thermal head so as to urge the recording medium and an ink sheet therebetween.

17. A color image recording apparatus according to claim 16; wherein one of the thermal head and platen roller is relatively movable with respect to the other so as to selectively press together the ink sheet and the recording medium against the thermal head.

18. A color image recording apparatus according to claim 17; further comprising feed rollers for feeding the recording medium; and means for selectively driving the platen roller and the feed rollers together in clockwise and counterclockwise directions so as to feed the recording medium in forward and reverse directions.

19. A color image recording apparatus according to claim 18; further comprising supply means for supplying a blank recording medium to the platen roller and discharge means for discharging the recording medium after recording of the image thereon.

20. A color image recording apparatus according to claim 19; further comprising an ink sheet supply roller for maintaining a roll of ink sheet material and an ink sheet take-up roller for taking up a used portion of the ink sheet.

21. A color image recording apparatus according to claim 20; further comprising a peel plate for peeling the ink sheet from the recording medium after thermal transfer has been made.

22. A color image recording apparatus according to claim 21; wherein the recording elements comprise printing elements arranged in a recording head; and wherein the energy application means includes control means having an image signal interface portion for receiving image data from a host computer and converting the image data to a predefined format, a frame memory for storing the image data in the predefined format, a resolution converting section for reading out the image data from the frame memory and converting the resolution of the image data to a resolution determined based upon the color of the image data, a dither processing section for superposing a dither matrix onto the image data output by the resolution converting section so as to obtain image data with a predetermined number of gradations, a mask processing section for performing mask processing on the image data output by the dither processing section, a line memory for storing image data for at least one line of record dots to be printed according to the output of the mask processing section, a data generating section for generating data used for driving the individual printing elements of the recording head based upon the data stored in the line memory, and a strobing pulse generator for generating pulses having a pulse width determined based upon the gradation of the image data stored in the line memory.

23. An apparatus for recording a color image by forming recording dots of at least first through third colors on a recording medium in a plurality of lines of recording dots each extending in a main scan direction and a plurality of rows of recording dots each extending in a sub-scan direction, comprising:

a recording head for printing the recording dots on the recording medium;

conveying means for conveying the recording medium with respect to the recording element for printing of the recording dots on the recording medium;

means for applying energy to the recording element to print an image in accordance with image data; and means for controlling the recording element, the conveying means and the means for applying energy such that the recording dots of first through third colors are each formed with a different printing pattern effective to avoid the occurrence of color fringes.

24. A method for recording a color image comprising recording dots of at least first through third colors formed on a recording medium in a plurality of lines of recording dots each extending in a main scan direction and a plurality of rows of recording dots each extending in a sub-scan direction, the method comprising the steps of:

forming a plurality of lines of recording dots of the first color on the recording medium so that the dots are printed according to a rule wherein a plurality of first recording dot groups each comprising a pair of adjacent recording dots printed in the same sub-line in two or more adjacent rows in the main canning direction are arranged periodically throughout a printing region;

forming a plurality of lines of recording dots of a second color on the recording medium so that the dots are printed according to a rule wherein with respect to recording dots printed in the same row in the main scanning direction, one odd number line and one even number line in the sub-scanning direction are formed to be separated by one sub-line or more to form a second recording dot group, and in adjacent rows in the main scanning direction, positions where the second recording dot group is formed are different from each other; and forming a plurality of lines of recording dots of a third color so that the recording dots are formed in accordance with a rule different from that of the first and second colors.

25. A method for recording a color image according to claim 24; wherein the step of forming a plurality of lines of recording dots of the first color further comprises the steps of forming a recording dot adjacent to one of the recording dots in each of the first recording dot groups so that the recording dots of the first recording dot groups and the adjacent dots are in contact with each other or overlapped with each other when printing gradation is high, and forming a combination of a respective first recording dot group and the adjacent dot along with a combination of another first recording dot group and another adjacent dot so that they are arranged to be separated by one or more sub-lines or one or more rows.

* * * * *